US005791663A

United States Patent [19]

Klukos

[11] Patent Number: 5,791,663

[45] Date of Patent: Aug. 11, 1998

[54] BRAKE SYSTEM FOR ROLLER SKATES

[76] Inventor: Edward O. Klukos, 10030 152nd Ave., West Olive, Mich. 49460

[21] Appl. No.: 740,497

[22] Filed: Oct. 30, 1996

Related U.S. Application Data

[63] Continuation-in-part of Ser. No. 442,950, May 17, 1995, Pat. No. 5,630,597, which is a continuation-in-part of Ser. No. 302,046, Sep. 7, 1994, Pat. No. 5,511,803.

[51] Int. Cl.[6] ..... A63C 17/14

[52] U.S. Cl. ..... 280/11.2; 188/5

[58] Field of Search ..... 280/11.2, 11.22, 280/11.27; 301/5.3; 188/5, 77 R, 80, 249, 259

[56] References Cited

U.S. PATENT DOCUMENTS

| | | | |
|---|---|---|---|
| 334,739 | 1/1886 | Blum . | |
| 968,427 | 8/1910 | Simon . | |
| 982,846 | 1/1911 | Nesbitt, Sr. | 280/11.2 |
| 1,497,224 | 6/1924 | Ormiston | 280/11.2 |
| 1,628,004 | 5/1927 | Stetson | 280/11.2 X |
| 2,027,487 | 1/1936 | Means . | |
| 2,644,692 | 7/1953 | Kahlert . | |
| 3,224,785 | 12/1965 | Stevenson . | |
| 4,088,334 | 5/1978 | Johnson . | |
| 4,275,895 | 6/1981 | Edwards . | |
| 4,402,520 | 9/1983 | Ziegler . | |
| 4,453,726 | 6/1984 | Ziegler . | |
| 5,052,701 | 10/1991 | Olson . | |
| 5,088,748 | 2/1992 | Koseika et al. . | |
| 5,135,244 | 8/1992 | Allison . | |
| 5,183,275 | 2/1993 | Hoskin . | |
| 5,192,099 | 3/1993 | Riutta . | |
| 5,207,438 | 5/1993 | Landers | 188/5 X |
| 5,232,231 | 8/1993 | Carlsmith . | |
| 5,280,931 | 1/1994 | Horton . | |
| 5,308,093 | 5/1994 | Walin . | |
| 5,465,984 | 11/1995 | Pellegrini, Jr. et al. . | |

FOREIGN PATENT DOCUMENTS

585764B1 3/1994 European Pat. Off. .

OTHER PUBLICATIONS

Exhibit A is a product brochure entitled "Bravoblade" published by Rollerblade, Inc., of Minnetonka, Minnesota, copyright 1993, disclosing an in-line roller skate including a cuff-actuated brake.

Exhibit B is a product brochure entitled "Roller Stop" published by Roller Stop, Inc., Malden, Massachusetts, publication date unknown, disclosing an in-line roller skate including a retrofittable brake system.

(List continued on next page.)

*Primary Examiner*—Brian L. Johnson
*Assistant Examiner*—Michael Mar
*Attorney, Agent, or Firm*—Price, Heneveld, Cooper, DeWitt & Litton

[57] ABSTRACT

A braking system is provided for an in-line roller skate for skating on hard skate-supporting surfaces. The roller skate includes a shoe, a wheel-supporting frame attached to the shoe, and a plurality of aligned wheels operably supported by the wheel-supporting frame. The braking system includes a hub supported on the frame and a ground engaging braking wheel rotatably supported on the hub. The hub and the ground engaging braking wheel include friction-generating surfaces such that the ground engaging braking wheel causes a braking action with the hub as the braking wheel rollingly engages with the ground supporting surface. A variety of configurations of the hub are disclosed including cuff-actuated systems and frame-fixed systems, and including a plurality of hub configurations including one-piece, multi-piece and wrapped, multi-piece and levered, and spring-biased split hub versions.

22 Claims, 19 Drawing Sheets

OTHER PUBLICATIONS

Exhibit C is a product brochure entitled "Grip In-Line Speed Control" published by Grip Inc., Boulder, Colorado, publication date unknown (but post marked as mailed Nov., 1993), disclosing an in-line roller skate including a cable-operated remote-actuated braking system.

Exhibit D is a product brochure entitled "1994 Oxygen Inline Skates" published by Atomic for Sport, Amherst, New Hampshire, publication date unknown, disclosing an in-line roller skate including a power braking system.

Exhibit E is an article entitled "Brake Wars In Chicago" published in the magazine *Inline Retailer & Industry News*, vol. 3, Issue 5, Aug. 15, 1994, on the cover page and page 19, which discloses three brake mechanisms, at least one of which includes a roller brake and a spring-loaded disc brake. The Examiner's attention is directed to the photographs on the right of the cover page and the text of columns one and two on the cover page.

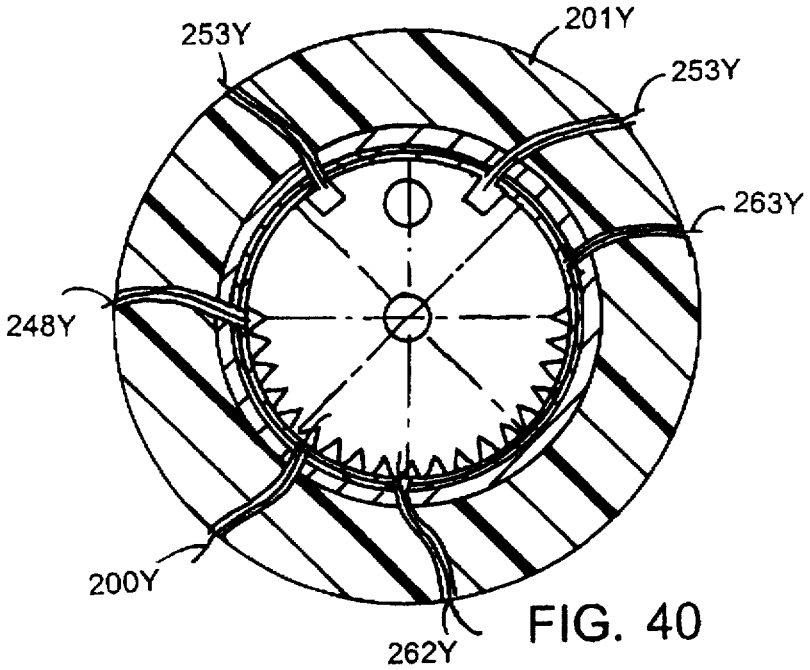
FIG. 40
FIG. 55
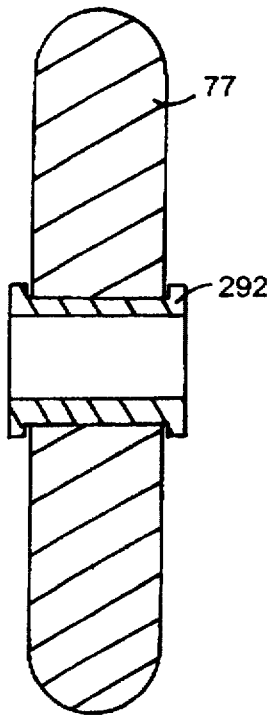

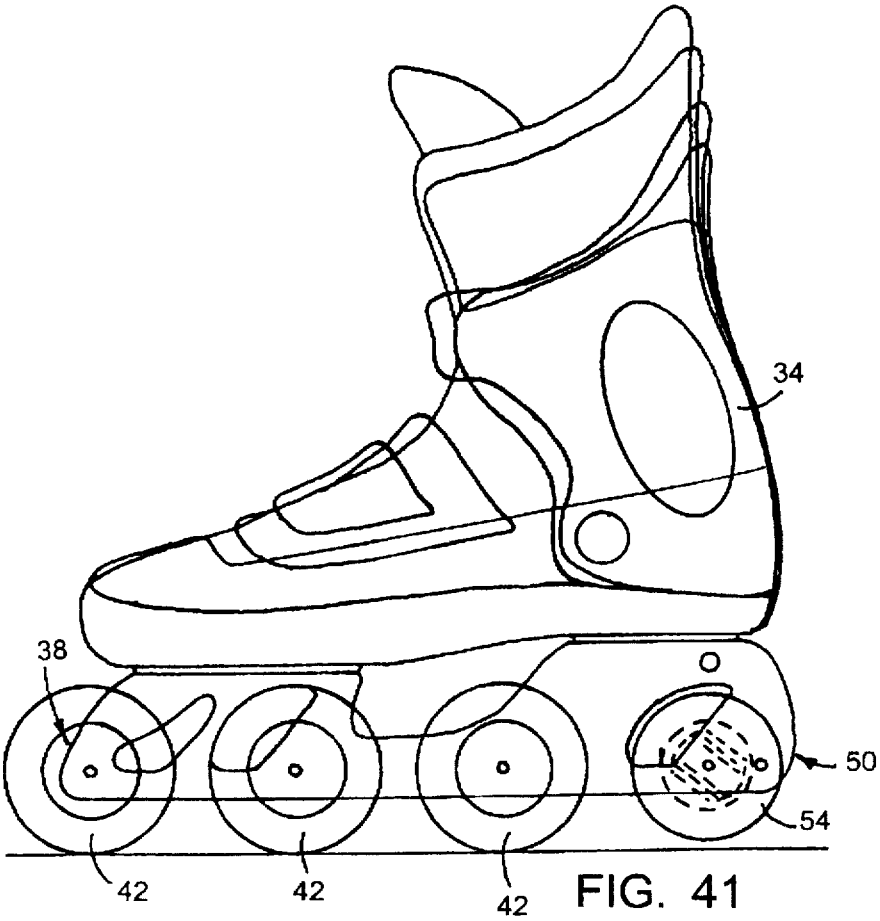
FIG. 41
FIG. 42
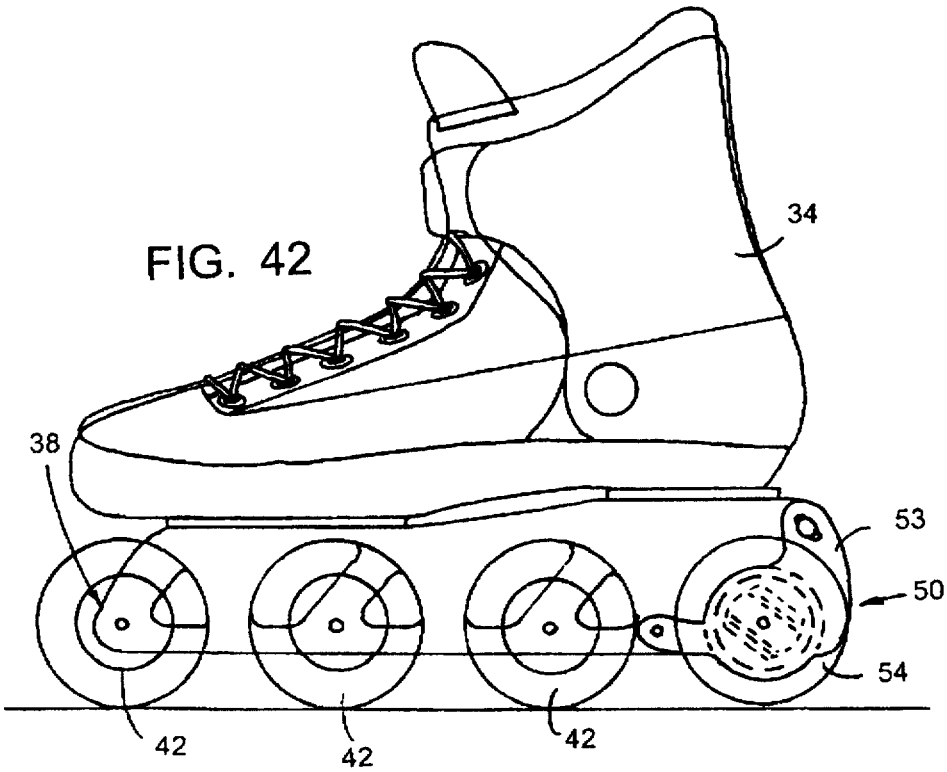

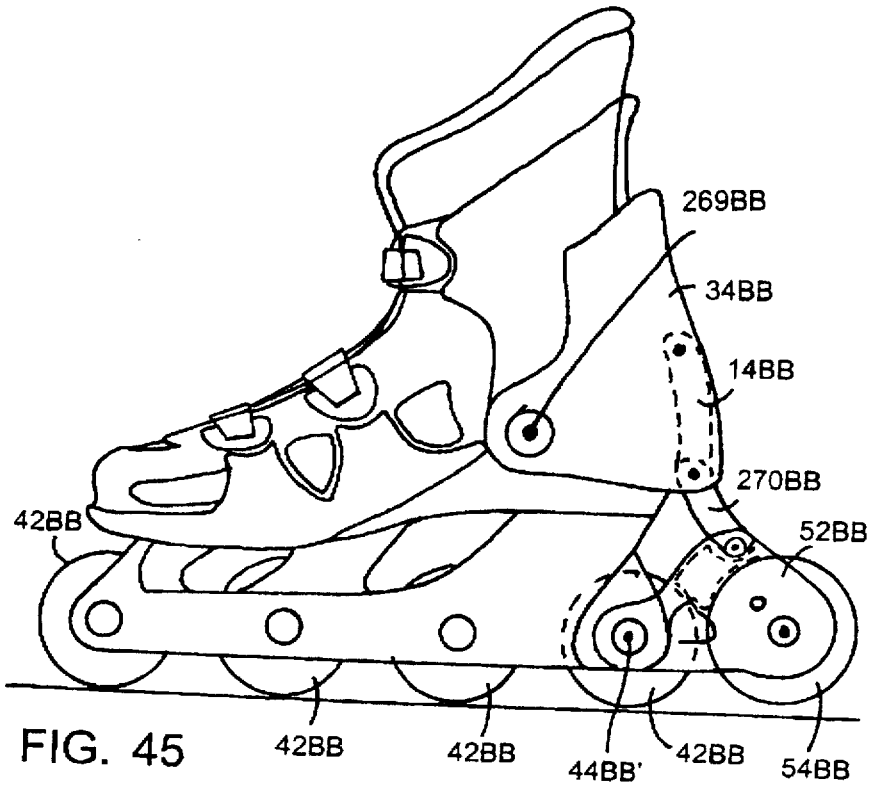
FIG. 45
FIG. 46
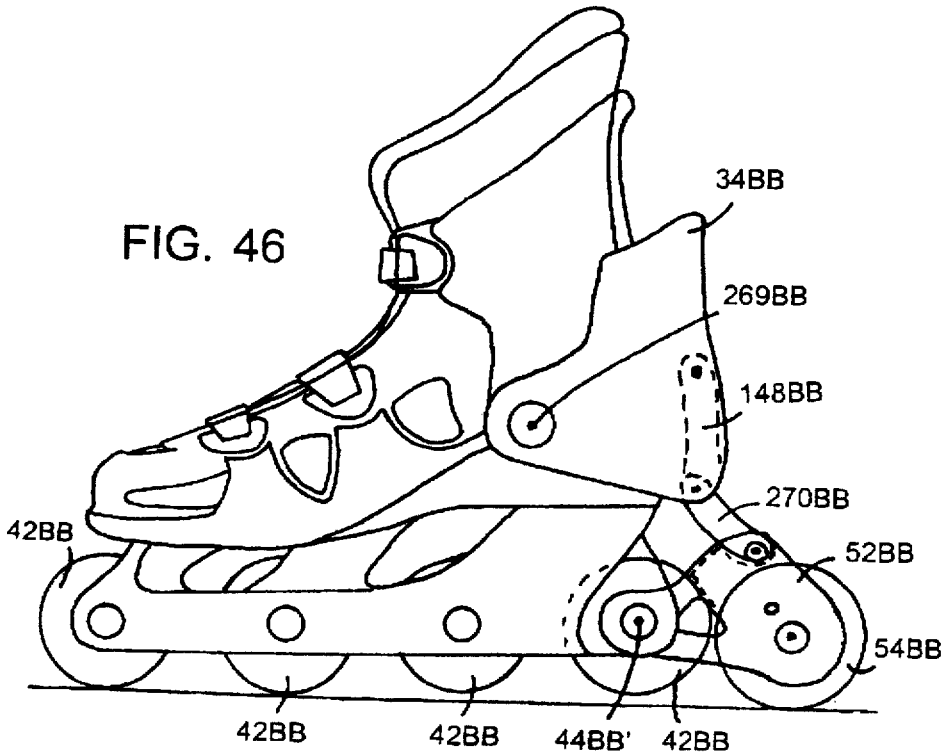

BRAKE SYSTEM FOR ROLLER SKATES

CROSS REFERENCE TO RELATED APPLICATION

This application is a continuation-in-part of application Ser. No. 08/442,950, filed May 17, 1995, entitled BRAKE SYSTEM FOR ROLLER SKATES, now U.S. Pat. No. 5,630,597; which is a continuation-in-part of application Ser. No. 08/302,046, filed Sep. 7, 1994, entitled BRAKE FOR ROLLER SKATES, now U.S. Pat. No. 5,511,803.

BACKGROUND OF THE INVENTION

This invention relates to brake systems, and more particularly relates to a brake for roller skates, although not limited to only roller skates.

Skaters using in-line roller skates must be able to safely stop or slow down regardless of their expertise, and further must always be "in control" so that they do not risk running into other skaters or bystanders. Beginners in particular have problems as they are learning to skate due to the free running nature of roller skates. However, more experienced skaters also desire fine levels of control to facilitate quick turns and stops. A number of roller skate brakes have been constructed for these purposes. However, known roller skate brakes have several problems as noted below.

The most common braking system now used on in-line roller skates includes a wear block attached to a rear of the skate that can be dragged on a skating surface to provide a braking action.

However, the wear block rapidly wears away and thus has a limited life. Further, the wear block is subject to catching or hooking on depressions, such as on the edges of or depressions in concrete sections in a sidewalk, such that the user may trip and fall. Still further, a wear block will often pick up small stones that embed themselves in the wear block. These small stones dramatically change the coefficient of friction generated by the wear block as the wear block is dragged on the skating surface, thus causing the brake to provide an uncertain and inconsistent brake force.

Some in-line roller skate brakes apply a braking force to one or more of the "active" weight-supporting wheels on the skate. For example, see U.S. Pat. No. 5,232,231 to Carlsmith. However, if any of these "active" weight-supporting wheels lock up or skid, a flat spot is created on the wheel. This flat spot causes the roller skate to vibrate during use, which is very annoying and also physically tiring. Further, the vibration caused by an "active" wheel having a flat spot takes away tremendously from the enjoyment of skating. Notably, the "active" wheels on the in-line roller skates periodically support less than an equal portion of a person's weight due to unevenness of the skating surface. Thus, it is relatively common for an "active" wheel that is being braked to skid and develop a flat spot. Another problem is that brakes sometimes stick or drag, thus causing a skater to unknowingly expend extra effort when skating.

U.S. Pat. No. 5,183,275 to Hoskin discloses a roller skate brake including a brake pad and a roller for engaging the braking pad. However, the actuating mechanism in Hoskin '275 involves multiple links and a braking wheel that are relatively small and intricate, such that they are mechanically more delicate and expensive to manufacture and assemble than are desired. Further, in Hoskin '275, the braking wheel, in addition to engaging the brake pad, also engages the rear in-line weight bearing wheel on the roller skate, thus leading to the problem of flat spots previously discussed above.

U.S. Pat. No. 5,192,099 to Ruitta discloses a roller skate including a brake pad and a rear skate wheel mounted on flexible side members that flex so that the rear skate wheel can be moved into engagement with the brake pad. The brake pad is adjustable to various fixed positions along a slot to compensate for wheel and brake pad wear. However, the problem of flat spots on wheels is not addressed. Also, the flexibility of the side members brings the durability and mechanical stability of the side members into question since, if the side members are vertically flexible along a "long" side of the cross section, they would tend to permit lateral movement and wandering of the rear wheel.

U.S. Pat. No. 5,088,748 to Koselka et al. discloses in FIG. 1 a braking system in which a braking wheel and braking member are pivotally mounted to the roller skate by a four-bar linkage.

As a practical matter, the multiple joints in the linkages are difficult to manufacture so that they operate freely yet without sloppiness. Further, even if manufactured properly, the joints are likely to loosen over time. Still further, the braking member operates on the hub of the braking wheel, such that the torque arm is small and the frictional braking force must be quite large in order to generate a desired level of braking torque on the braking wheel. Also, the device lacks adjustability. The embodiments in FIGS. 4 and 5 do not have the four bar linkage, but rather have a pair of trailing arms supporting a braking wheel. However, the braking member operates to brake the rear weight-supporting wheel on the roller skate, thus leading to the problem of flat spots discussed above.

U.S. Pat. No. 4,453,726 and 4,402,520 to Ziegler disclose traditional four wheeled roller skates where the wheels are arranged in a rectangular pattern. The roller skates include a braking wheel that cams pressure elements outwardly against two axially aligned roller wheels. Notably, the camming action tends to force the wheels apart, such that the bearings on the rear skate wheels may need constant maintenance or may fail prematurely. Further, it is noted that major modifications would be required to apply the braking system in Ziegler to an in-line roller skate.

U.S. Pat. No. 4,275,895 to Edwards discloses a cuff-actuated braking system including a brake pad that engages the two rear wheels of a rectangularly arranged, four wheel skate. (See FIG. 3.) Notably, the brake pad engages the rear wheels, and thus flat spots and wheel wear can be a problem. Also, major modifications would be required to apply the braking system in Edwards to an in-line roller skate.

U.S. Pat. No. 2,027,487 to Means discloses a brake pad attached to a flexible support that can be flexed to engage the brake pad with the rear roller skate. In addition to the problems previously discussed relating to rear wheel flat spots and wear, major modification is required to use the device on in-line roller skates.

Aside from the above, the known roller skate brakes do not provide a natural and smooth "feel" to the skater when braking. I have not determined exactly why this is true, but I believe it to be due in part to the multiple joints and flexibility of the parts used in many of the prior art brakes, and the inability of the known constructions to provide a consistent and uniformly increasing braking force that is directly correlated to the amount of force transmitted from the skate-supporting surface to the brake. Also, it is noted that many of the prior art brakes are expensive to manufacture, are expensive to maintain, and also are difficult to adjust and/or keep in adjustment.

In addition to the above, a braking system for in-line roller skates, skate boards, and quad skates is desired that provides a compact unit attachable to the skates or boards without multiple separate links, connections, and moving parts.

Still further, an internal braking system is desired for use in weight-supporting wheel constructions, such as for use in roller wheels on gravity feed or powered conveyors.

Thus, braking systems for in-line roller skates and other wheel constructions solving the aforementioned problems are desired.

SUMMARY OF THE INVENTION

The present invention includes an in-line roller skate having a wheeled frame with a hub-supporting sub-frame, a plurality of aligned wheels operably supported by the wheeled frame, and a braking mechanism including a hub and a braking wheel supported on a perimeter surface of the hub. The hub includes a strip of material extending at least partially around the hub to generate a braking force when the roller skate is pivoted to rollingly engage the braking wheel with a hard surface.

These and other advantages and features of the present invention will be further understood by a person of ordinary skill in the art by a review of the attached specification, claims, and appended drawings.

BRIEF DESCRIPTION OF THE DRAWINGS

FIG. 40 is a side view of another internal braking system embodying the present invention;

FIG. 41 is a side view of an in-line skate with a braking system embodying the present invention;

FIG. 42 is a side view of an in-line skate with a braking system embodying the present invention;

FIG. 45 is a side view of a modified in-line skate with a braking system embodying the present invention that is not unlike the embodiment of FIG. 43 and where the braking system is not engaged;

FIG. 46 is a side view of the in-line skate of FIG. 45 where the braking system is engaged;

FIG. 55 is a cross-sectional view of a snap-attach skate tire on a particularly configured mating hub.

DETAILED DESCRIPTION OF THE PREFERRED EMBODIMENTS

Figures 1, 5, 6, 18:
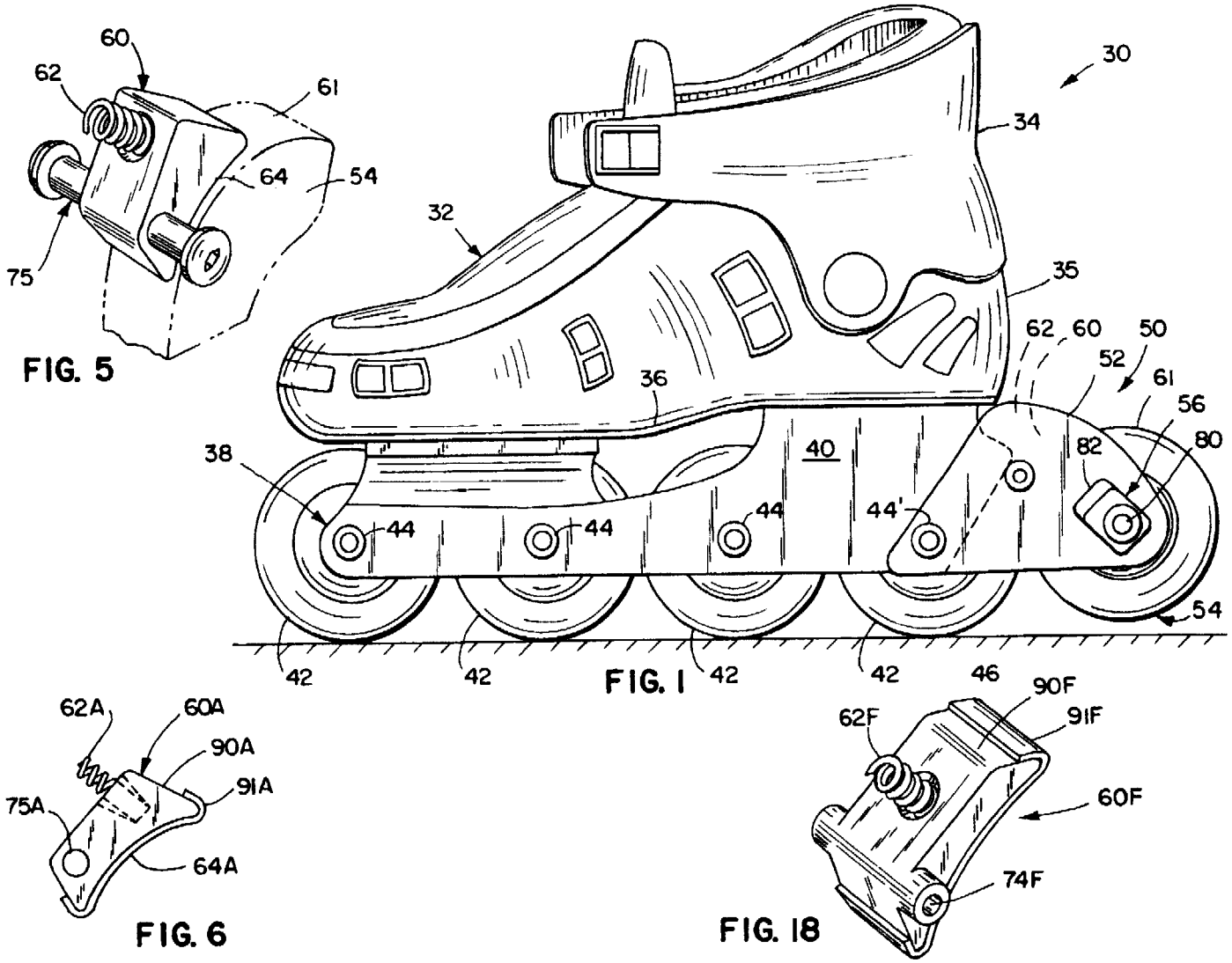
FIG. 1 is a side view of an in-line skate embodying the present invention.
FIG. 5 is a perspective view of the brake pad and pivot pin supporting the brake pad, the braking wheel being shown in phantom and the extension having been removed to better show the arrangement of the brake pad and braking wheel.
FIG. 6 is a side view of a modified brake pad.
FIG. 18 is a perspective view of the braking pad shown in FIG. 16.

An in-line roller skate 30 (FIG. 1) embodying the present invention includes a shoe 32 having a cuff or ankle support 34, a boot 35, and a sole 36. A wheel-supporting frame 38 is attached to the bottom of sole 36. Wheel-supporting frame 38 includes a pair of spaced apart flanges 40 that extend downwardly, and four aligned "active" weight-supporting wheels 42 and 42" (wheel 42" being the rear wheel) are operably secured between flanges 40 on axles 44 by roller bearings (not specifically shown). Wheels 42 and 42' define a vertical plane and the bottommost points on wheels 42 and 42' are co-linear so that they simultaneously engage a skate-supporting surface 46, such as a cement or pavement covered sidewalk or parking lot. The present invention is focused on the braking system 50 attached to the rear of frame 38.

Braking system 50 (FIG. 1) includes a U-shaped extension 52 fixedly connected to the rear of frame 38. Extension 52 includes slots 82 and 85 for slideably receiving a support mechanism 56. An axle 80 operably rotatably supports a braking wheel 54 on support mechanism 56. A brake pad 60 is adjustably secured to extension 52 proximate the outer upper surface 61 of braking wheel 54, and a spring 62 biases the brake pad 60 against braking wheel 54. As a skater initially pivots skate 30 rearwardly about the rear wheel 42', braking wheel 54 rollingly engages hard surface 46 and rubs against braking surface 64 of braking pad 60 to create an initial predetermined level of braking force. Since the skate-supporting surface 46 is rougher than the brake pad 60, the braking wheel 54 rolls on surface 46 rather then slides or skids. As the skater further pivots rearwardly, skate-supporting surface 46 presses against braking wheel 54 with increased pressure causing slide mechanism 56 to move braking wheel 54 toward brake pad 60, thus increasing the frictional braking force on braking wheel 54.

By adjusting the tension on spring 62 such as by placing spacers under the spring, or by replacing spring 62 with a stronger or weaker spring, the frictional force/displacement curve of brake pad 60 on braking wheel 54 can be selectively preset, both when the spring 62 is fully extended and when spring 62 is partially compressed by movement of braking wheel 54. Thus, the initial braking force and also the load/deflection curve of the brake pad and braking wheel can be controlled for optimal function and performance. Notably, support mechanism 56 can be designed to limit the movement of braking wheel 54 toward brake pad 60 to prevent lock up of braking wheel 54 if desired, such as by designing support mechanism 58 to engage the end of slot 82 before braking wheel 54 engages brake pad 60 with a lock up force. It is noted that the angle of slot 82 is important since this determines the resultant force along slot 82 caused by forces transmitted from ground 46 through wheel 54 to extension 52. An angle of about 45° has been found to be preferable. Angles that are closer to vertical than 45° tend to cause wheel 54 to lock up, and angles that are closer to horizontal than 45° tend to provide too low of braking forces. At 45°, a desired balance is achieved between the torque generated by the ground on the braking wheel and the braking torque generated by brake pad 60. It is noted that many variables offset the braking force and/or the tendency to lock up the braking wheel, such as the materials chosen, torque arms, coefficients of friction, and the like.

Figure 3:
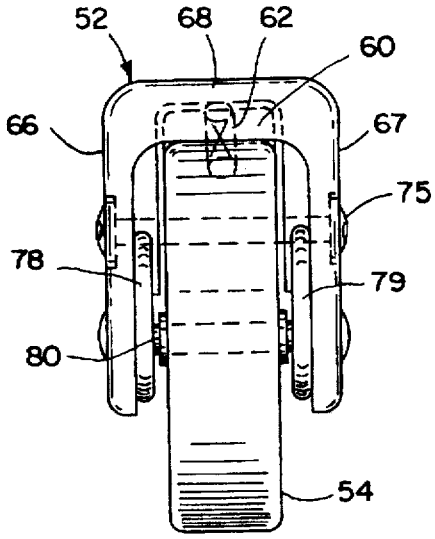
FIG. 3 is a rear end view of the braking system shown in FIG. 2.
Figure 4:
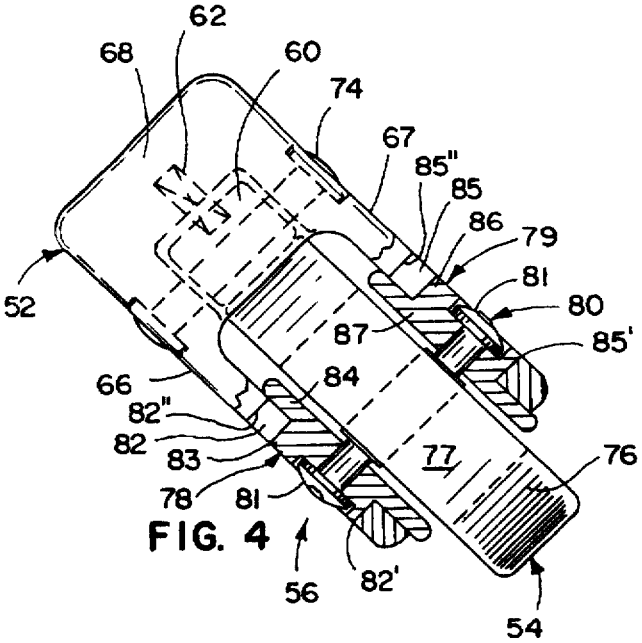
FIG. 4 is a cross-sectional view taken along the lines IV—IV in FIG. 2.
Figure 7:
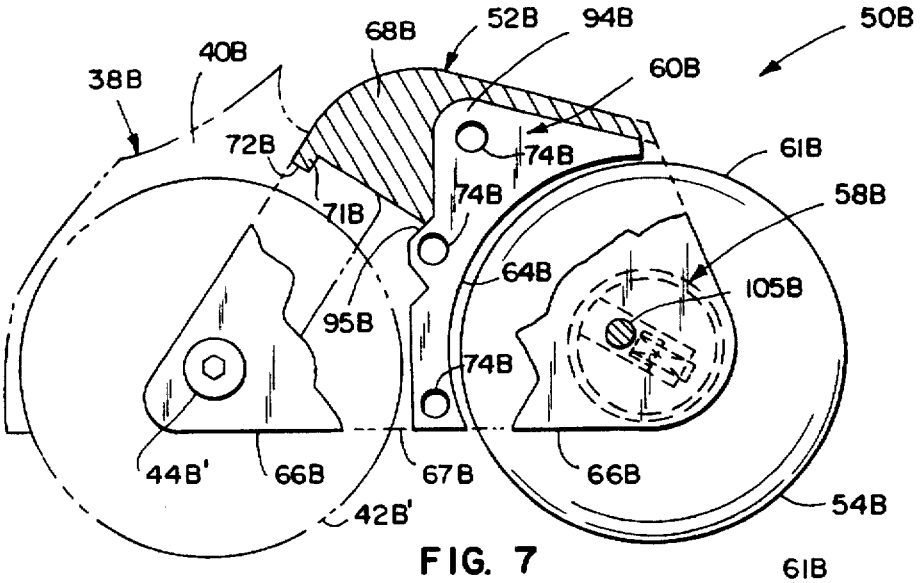
FIG. 7 is an enlarged, fragmentary side view partially in cross section of a modified braking system embodying the present invention.
Figure 8:
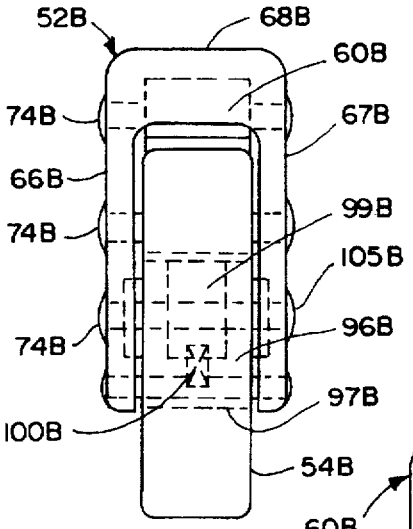
FIG. 8 is a rear view of the braking system shown in FIG. 7.
Figure 9:
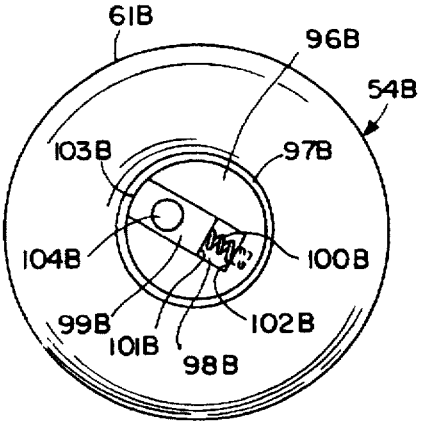
FIG. 9 is a side view of the wheel including the slotted hub, and the slide members shown in FIG. 7.
Figure 10:
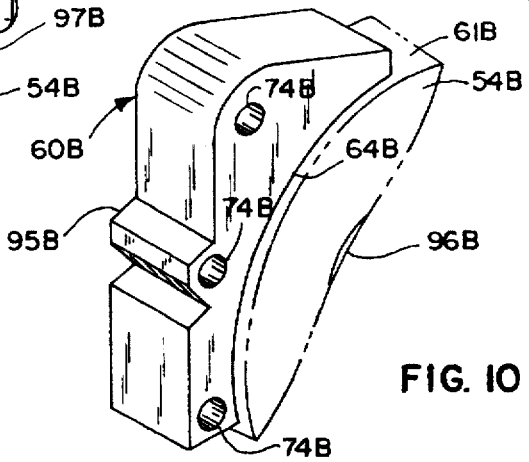
FIG. 10 is a perspective view of the braking pad shown in FIG. 7, the braking wheel being shown in phantom and the extension having been removed to reveal the arrangement of the braking pad and braking wheel.
Figure 11:
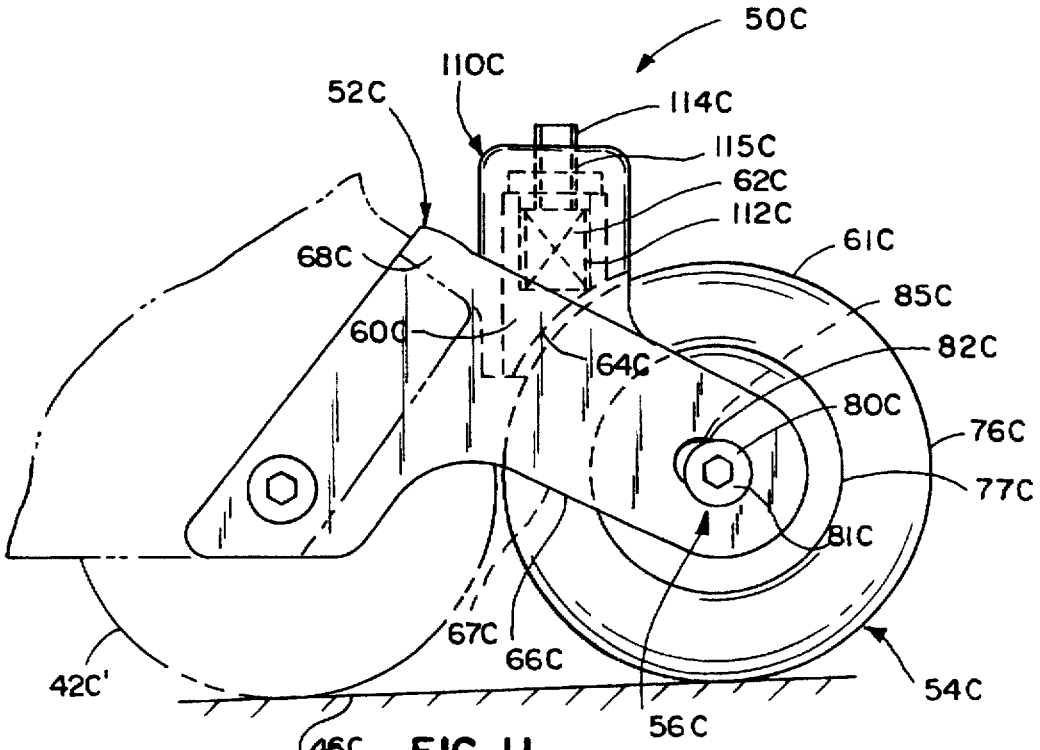
FIG. 11 is an enlarged, fragmentary side view of another braking system embodying the present invention.
Figure 12:
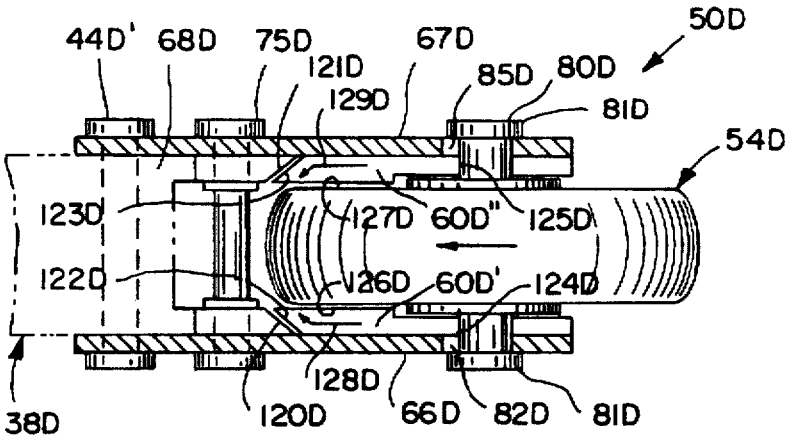
FIG. 12 is an enlarged, fragmentary top view of yet another braking system embodying the present invention.
Figure 13:
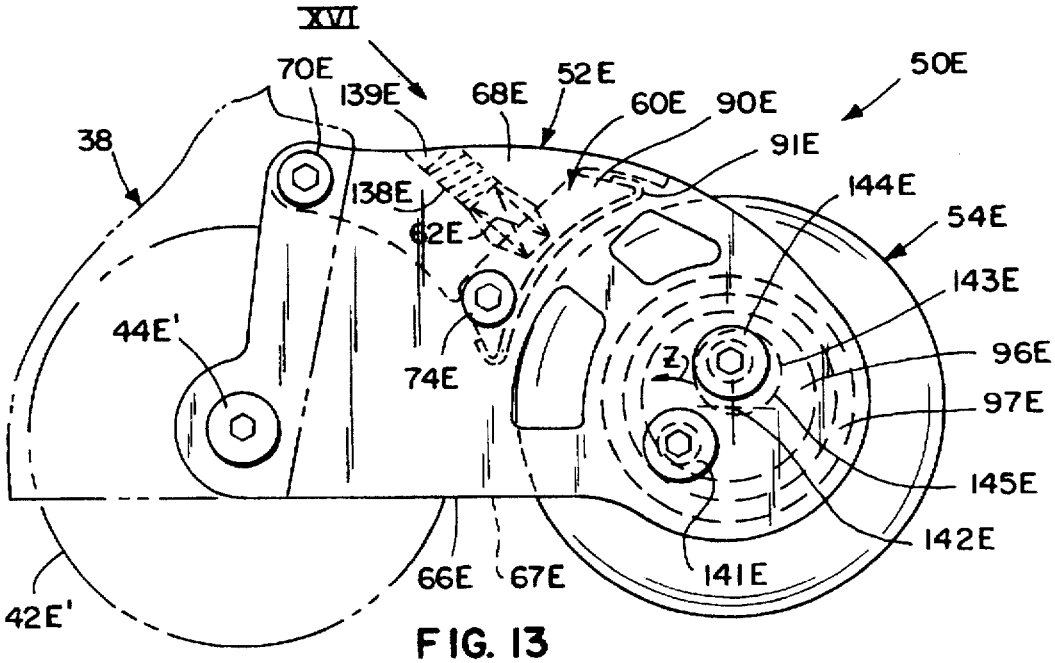
FIG. 13 is an enlarged fragmentary side view of yet another braking system embodying the present invention.
Figure 14:
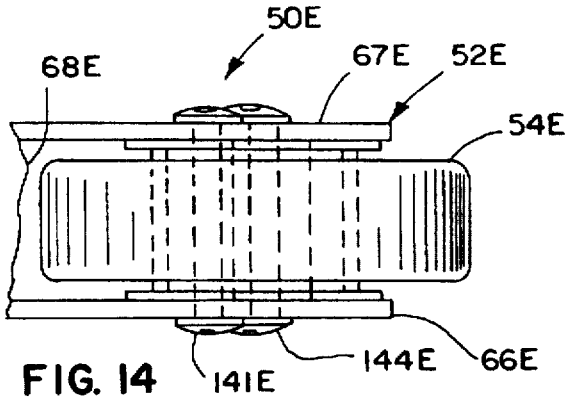
FIG. 14 is a fragmentary top view of the braking system shown in FIG. 13.
Figure 15:
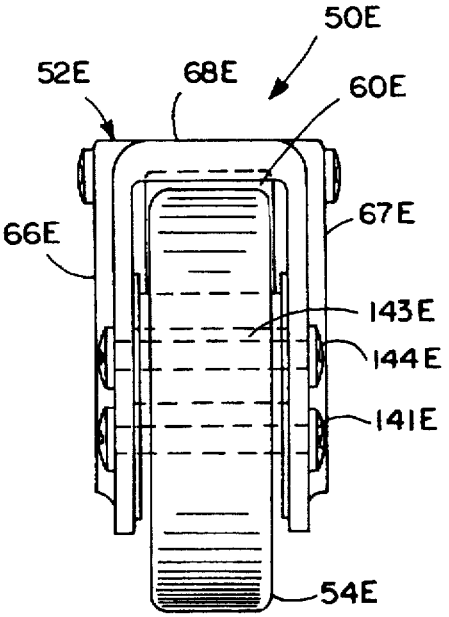
FIG. 15 is a rear view of the braking system shown in FIG. 13.
Figure 16:
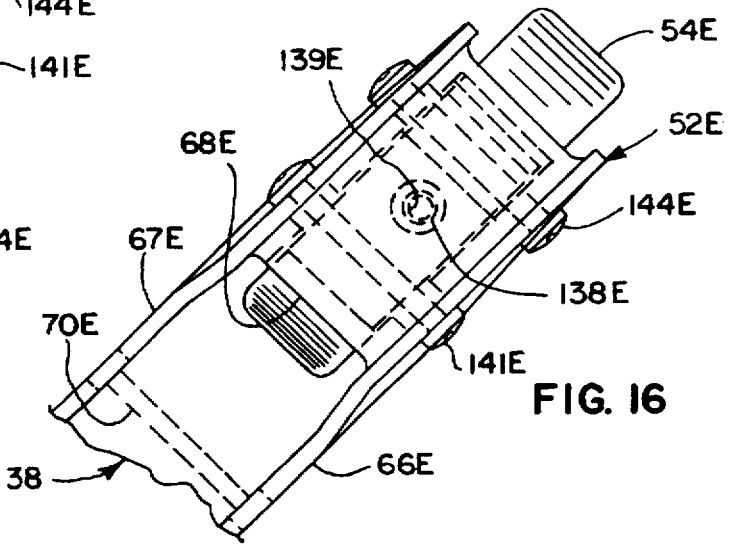
FIG. 16 is a top view taken in the direction of arrow 16 in FIG. 13.

Extension 52 (FIGS. 2–4) is U-shaped and includes opposing side flanges 66 and 67 interconnected by an intermediate transverse section 68. The extension flanges 66 and 67 are spaced apart to mateably engage the outside surfaces of wheel frame flanges 40, and transverse section 68 is configured to mateably engage a tail section 69 on wheel frame flanges 40. The rivet-like axle 44' extends through holes in flanges 66 and 67 and through corresponding holes in wheel frame flanges 40. Also, a tab 71 on transverse section 68 engages a mating notch 72 on tail section 69. Axle 44' and tab 71 fixedly retain extension 52 on wheel-supporting frame 38. Notably, retainer arrangements other than tab 71 and notch 72 can also be used, such as a link connected to the frame 38 or to the cuff support 34, or another fastener.

Brake pad 60 is positioned in the pocket between flanges 66 and 67 under transverse section 68. A rivet-like fastener 74 extends through flanges 66 and 67 and through a hole 75 in brake pad 60 to pivotally support brake pad 60 on extension 52. Transverse section 68 and brake pad 60 define opposing depressions that are generally aligned for receiving coil spring 62. Coil spring 62 is compressed in these depressions and accordingly biases brake pad 60 rotatingly about rivet 74 toward braking wheel 54. Brake pad 60 includes an arcuately shaped surface 64 for engaging the outer surface 61 of braking wheel 54. By engaging outer surface 61 of braking wheel 54, the friction of brake pad 60 on braking wheel 54 operates over a maximum torque arm for maximum braking force on braking wheel 54 while not unnecessarily wearing braking wheel 54. Notably, the leading edge of brake pad 60 acts as a wiper to keep braking wheel 54 clean, as well as to keep dirt from getting onto braking surface 64. Also, this leading edge provides an initial braking force due to the bias of spring 62.

Braking wheel 54 includes a tire portion 76 and a hub portion 77 fixedly secured to tire portion 76. Support member 56 includes a pair of opposing slide members 78 and 79 (FIG. 6) positioned on opposing sides of hub portion 77 that are retained thereto by the axle 80. Axle 80 includes opposing sections that mateably threadably engage and that include capped ends 81 to retain axle 80 in place once installed in slide members 78 and 79 and braking wheel 54. Roller bearings (not specifically shown) support hub portion 77 on axle 80. Alternatively, a solid lubricated bearing can be used in place of roller bearings. Extension flange 66 includes a slot 82 that extends toward brake pad 60. Slide member 78 includes a rectangular section 83 for slideably engaging slot 82, and a planar section 84 for slideably engaging the inside surface of extension flange 66. Similarly, extension flange 67 includes a slot 85 that extends toward brake pad 60. Also, slide member 79 includes a rectangular section 86 for slideably engaging slot 85 in extension flange 67, and a planar section 87 for slideably engaging the inside surface of extension flange 67. Thus, slide members 78 and 79, braking wheel 54 and axle 80 are adapted to slide as a unit along slots 82 and 85 toward (and away from) brake pad 60. However, spring 62 biases brake pad 60 against braking wheel 54, causing braking wheel 54 to move to the brake-pad-remote ends 82' and 85' of slots 82 and 85.

Figure 2:
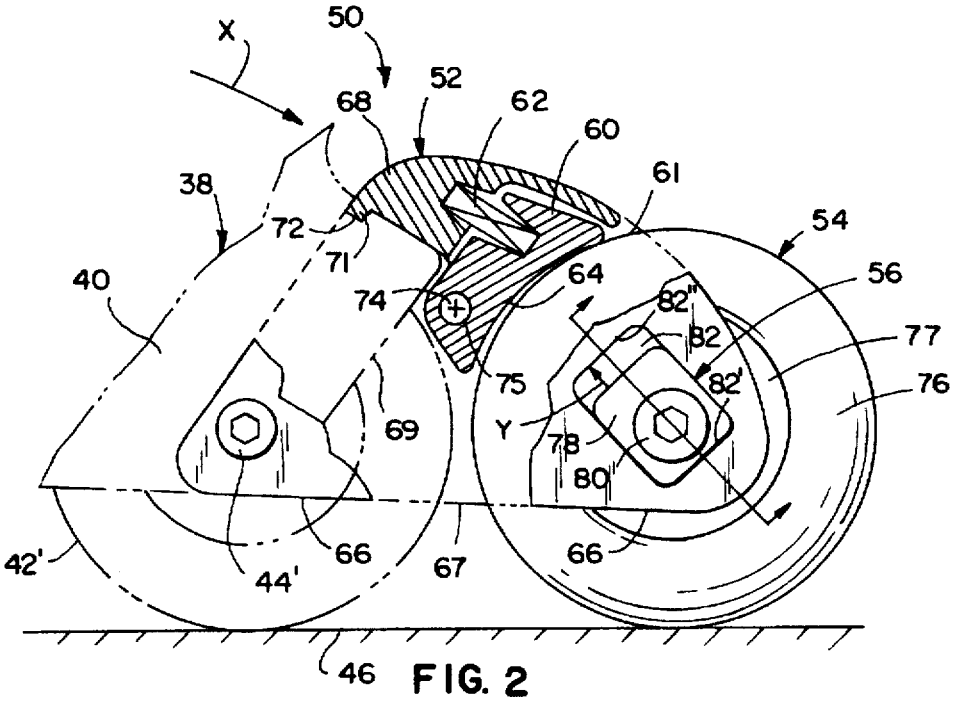
FIG. 2 is an enlarged, fragmentary side view partially in cross section of the braking system shown in FIG. 1.

To apply a braking force to in-line roller skate 30, a skater pivots rearwardly in direction "X" about the rear weight bearing wheel 42' until braking wheel 54 engages skate-supporting surface 46 and begins to roll (FIG. 2). (Compare the relationship of braking wheel 54 and surface 46 in FIGS. 1–2.) The brake pad 60 (FIG. 2) frictionally drags on braking wheel 54 due to the bias of spring 62 which causes brake pad 60 to rotate about rivet 74 into engagement with braking wheel 54. Thus, an initial braking force is created to gradually slow down the speed of the skater. Notably, braking wheel 54 is interchangeable with wheels 42, thus reducing the need for an excessive number of special repair or replacement parts for braking system 50.

As the skater continues to pivot rearwardly an additional angular amount, skating surface 46 presses against braking wheel 54 with sufficient force to cause slide members 78 and 79 to slide along slots 82 and 85, respectively, in direction "Y". This carries braking wheel 54 into increasing frictional engagement with brake pad 60. In turn, spring 62 is compressed by the force on brake pad 60. Thus, the braking force is only gradually increased since brake pad 60, to a certain extent but with increasing resistance, moves with braking wheel 54.

Once slide members 78 and 79 reach the ends 82" and 85" of slots 82 and 85, braking wheel 54 cannot move any farther toward brake pad 60. Thus, the surfaces at the ends of slots 82 and 85 act as stops to limit the movement of braking wheel 54 and thus limit the maximum braking force that braking system 50 can generate. Alternatively, slots 82 and 85 can be designed so that the ends 82" and 85" are never reached by slide members 78 and 79. Notably, by changing the length and spring constant of spring 62, substantially any initial braking force and substantially any load/deflection curve can be obtained by braking system 50. Notably, the movement of braking wheel 54 directly into brake pad 60, and the overall arrangement of braking system 30, provides the skater with an excellent "feel" for the braking force, thus giving the skater excellent control. The arrangement allows axle 80 to "float" in direct response to the skater's movement, thus giving the skater a direct feel for the braking action. The arrangement, and in particular the orientation of slots 82 and 85, provides a mechanical advantage so that the frictional force between the braking wheel 54 and the hard surface 46 is always greater than the force between the brake pad 60 and the braking wheel 54. Thus, there is very little likelihood that braking wheel 54 will lock up and skid, even if the brakes are applied very hard.

Several additional embodiments of roller skates, braking systems and components thereof are shown in FIGS. 6–55. In these embodiments, to reduce redundant discussion, identical or comparable components and features are identified by use of identical numbers as used in describing roller skate 30, but with the addition of the letters "A", "B", "C" and etc.

A modified brake 60A (FIG. 6) includes a backing member or body 90A and a liner 91A. Body 90A is made from a durable, structural material such as a polymer, and brake liner 91A is made from a durable, wear-resistant material such as metal. The ends of liner 91A wrap around and snap lock onto body 90A. Alternatively, liner 91A can be insert molded into body 90A. Body 90A includes a hole 75A for receiving pivot pin 74A, and a depression for receiving an end section of spring 62A.

A modified braking system 50B (FIGS. 7–10) includes an extension 52B having opposing side flanges 66B and 67B interconnected by an intermediate section 68B. Brake pad 60B is fixedly secured to extension 52B by three rivet-like fasteners 74B. Brake pad 60B includes an arcuate surface 64B that extends about 90° around braking wheel outer surface 61B. The upper end 94B of brake pad 60B and a notch 95B on the back of brake pad 60B engage mating surfaces on intermediate flange 68B of extension 52B to fixedly support brake pad 60B.

Support mechanism 56B includes a hub 96B rotatably positioned in a centered hole in braking wheel 54B by roller bearings (not specifically shown, but located at raceway 97B). Hub 96B includes a rectangularly-shaped, radially extending slot 98B. A slide member 99B is slideably positioned in slot 98B, and hub 96B is biased in a direction parallel slot 98B by a spring 100B that is compressed between the inner end 101B of slide member 99B and the surface 102B of hub 96B forming the end of slot 98B. The outer end 103B of slide member 99B forms a section of the raceway for the roller bearings in raceway 97B, if roller bearings are used. Slide member 99B is secured at a desired angle between the inside surfaces of extension side members 66B and 67B at a predetermined angle for optional transfer of forces from ground through braking wheel 54B. This angle has been determined to be about 45° from horizontal for optimal results. Angles that are more vertical tend to allow the braking wheel 54B to lock up, while angles that are more horizontal tend to not provide enough braking force. A hole 104B extends through slide member 99B for receiving axle-like fastener 105B. Hub 96B is movable relative to extension side members 66B and 67B and slide member 99B.

Braking system 50B provides a longer wearing brake system than braking system 30 since a larger braking area is provided on surface 64B for engaging wheel outer surface 61B than on surface 64. Also, brake pad 60B is not moveable and thus less movement of braking wheel 54B is required than with wheel 54. Of course, the load/deflection curve of braking system 50B is dependent upon the spring constant of spring 100B and also on the frictional characteristics of materials used to manufacture brake pad 60B and braking wheel 54B. To operate braking system 50B, the skater pivots rearwardly on rear weight-supporting wheel 42B', causing braking wheel 54B and hub 96B to slide on slide member 99B toward brake pad 60B such that braking wheel 54B engages brake pad 60B.

Braking system 50C (FIG. 11) includes an extension 52C having slots 82C and 85C in extension flanges 66C and 67C. An axle 80C extends through and rotatably engages hub 77C to support braking wheel 54C. Axle 80C further extends through slots 82C and 85C, thus forming slide mechanism 56C. Capped ends 81C on axle 56C retain axle 56C in extension 52C. Axle 80C is slideable in slots 82C and 85C, and thus braking wheel 54C moves along slots 82C and 85C as roller skate 30C is pivoted rearwardly about rear wheel 42' and skate-supporting surface 46C presses on braking wheel 54C. 4

A stanchion 110C extends above intermediate section 68C. Stanchion 110C defines a generally vertically oriented pocket for slideably receiving a brake pad 60C. Brake pad 60C includes an arcuate surface 64C for engaging the outer surface 61C of braking wheel 54C. A spring 62C is positioned in a depression 112C in the top 113C of brake pad 60C. An adjustment screw 114C extends through a threaded hole 115C in the top of stanchion 110C. By adjusting screw 114C, the compression of spring 62C can be adjusted, and thus the braking force (i.e. the preload and also the load/deflection curve) can be adjusted. Notably, brake pad 60C is oriented generally tangentially to the outer surface 61C of braking wheel 54C in the direction of rotation of braking wheel 54C when it rollingly engages surface 46C. Due to the orientation of braking pad 60C, the frictional braking force between brake pad 60C and braking wheel 54C tends to draw brake pad 60C into increasing engagement, and thus the braking force is "artificially" amplified.

In the braking system 50D (FIG. 12), intermediate section 68D of extension 52D includes opposing ramps 120D and 121D adjacent the insides of opposing flanges 66D and 67D, respectively.

An axle 80D rotatably supports braking wheel 54D, and further slideably engages slots 82D and 85D in extension flanges 66D and 67D. Capped ends 81D retain axle 80D in extension 52D. In braking system 50D, a pair of opposing brake pads 60D' and 60D" are located between the sides of braking wheel 54D and extension flanges 66D and 67D, respectively. Ramps 122D and 123D are located on brake pads 60D' and 60D" proximate section ramps 120D and 121D. Axle 80D extends through holes 124D and 125D on brake pads 60D' and 60D", respectively. As roller skate 30D is pivoted rearwardly, braking wheel 54D rollingly engages skate-supporting surface 46D and is moved toward roller skate 30D. This causes axle 80D to slide along slots 82D and 85D. Axle 80D engages opposing brake pad 60D' and 60D", and also causes them to slide along the inside of extension flanges 66D and 67D. As brake pad ramps 122D and 123D engage extension ramps 120D and 121D, brake pads 60D' and 60D" move at an angle along paths 128D and 129D, and bind against the sides 126D and 127D of braking wheel 54D.

An advantage of braking system 50D is that brake pads 60D' and 60D" do not brake against the outer surface 61D of braking wheel 54D, but rather brake against wheel sides 126D and 127D which are relatively clean. Further, the outside diameter (61D) of braking wheel 54D does not change even if sides 126D and 127D wear. Another advantage is that a braking wheel 54D can be used that is interchangeable with the other wheels (e.g. wheels 42) on the roller skate 30D.

Notably, a fastener 75D extends through extension flanges 66D and 67D proximate extension ramps 120D and 121D at the points of highest stress. Thus, the strength of the design is not mechanically degraded by cyclical loading over time. Notably, the angle of ramps 120D–123D can be varied to achieve a particular load/deflection curve for the braking system 50D.

Braking system 50E (FIGS. 13–16) includes an extension 52E secured to wheel-supporting frame 38 by rear wheel axle 44E' and by rivet-like fastener 70E. Brake pad 60E is secured under intermediate section 68E by a rivet-like fastener 74E which pivotally retains brake pad 60E to extension 52E. A spring 62E seated in a depression in intermediate section 68E and biases brake pad 60E about fastener 74E into engagement with braking wheel 54E. Brake pad 60E includes a body 90E and a brake liner 91E, not unlike brake pad 60B (FIG. 6). An adjustment screw 138E engages spring 62E for adjusting the tension on brake pad 60E. Also, threaded passageway 139E provides a passageway for removal of spring 62E such as for replacing spring 62E. Apertures 140E in extension flanges 66E and 67E allow movement of air around brake pad 60E to cool brake pad 60E. Also, apertures 140E reduce the weight of the overall system, and also provide aesthetics.

A hub 96E (FIG. 13) is rotatably supported in braking wheel 54E by roller bearings or a solid bearing located along raceway 97E. An axle-like fastener 141E extends through hub 96E and rotatably supports hub 96E at a location spaced from the axis of rotation 142E for braking wheel 54E. Fastener 141E securely engages extension flanges 66E and 67E. An oversized aperture 143E is located in hub 96E offset from axis 142E and fastener 141E. A second fastener 144E extends through aperture 143E and is securely attached to extension flanges 66E and 67E. As braking wheel 54E engages skate-supporting surface 46E, braking wheel 54E is biased toward brake pad 60E. This causes hub 96E to pivot in direction "Z", which causes braking wheel 54E to move toward brake pad 60E. The rotation of hub 96E is limited (i.e. stopped) by the engagement of second fastener 144E with the side 145E of aperture 143E. Hub 96E and the related components 141E, 143E and 144E form slide mechanism 56E. The translating sliding motion of the mechanism is an arcuate motion as shown by arrow "Z", as opposed to a linear motion of the slide mechanisms shown in FIGS. 1–12.

Braking system 50F (FIGS. 17–18) includes an extension 52F pivotally connected to wheel-supporting frame 38F at the rear axle 44F' of rear skate wheel 42F'. The brake pad 60F and braking wheel 54F are substantially identical to brake pad 60E and braking wheel 54E in FIGS. 13–16. However, a cuff actuated link 148F is pivotally connected at one end to extension 52F at protrusion 149F and is pivotally connected at its other end to cuff support 34F at protrusion 150F. In addition to the movement of braking wheel 54F toward braking pad 60F, cuff actuated link 148F causes extension 52F and brake pad 60 to pivot about rear axle 44F' toward braking wheel 54F when the skater leans rearwardly on in-line skate 30F. Also, the forces generated on the ankle of the skater by link 148F gives the skater an excellent "feel" or sensitivity to the braking force being generated.

Figure 17:
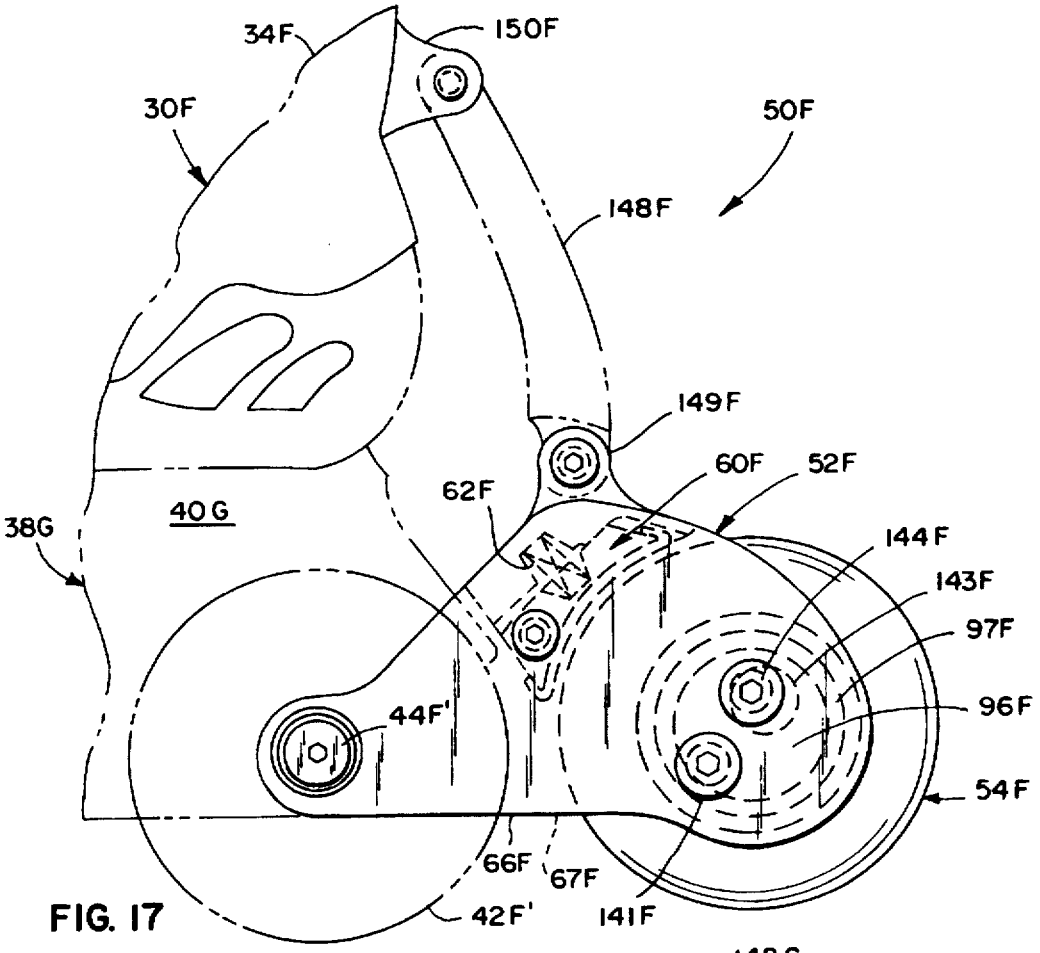
FIG. 17 is an enlarged, fragmentary side view of yet another braking system embodying the present invention.
Figure 19:
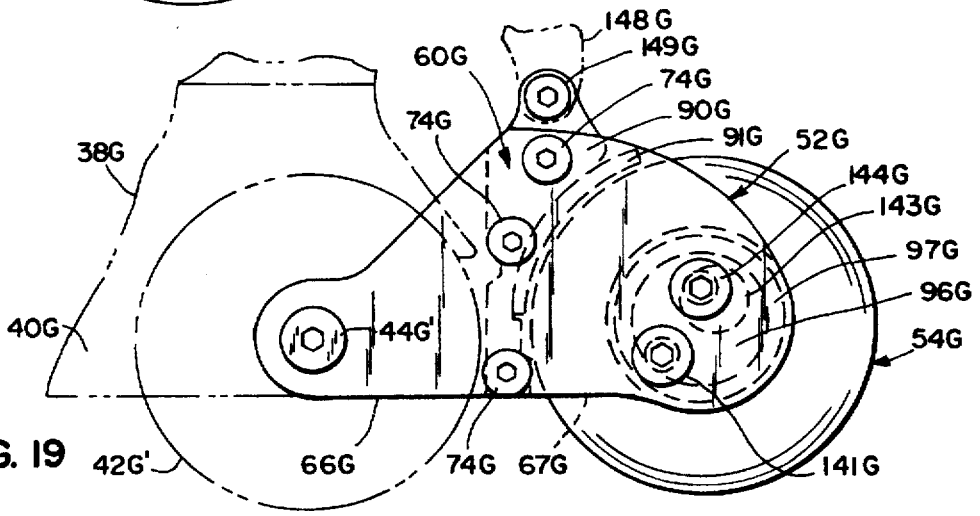
FIG. 19 is an enlarged, fragmentary side view of yet another braking system embodying the present invention.
Figure 20:
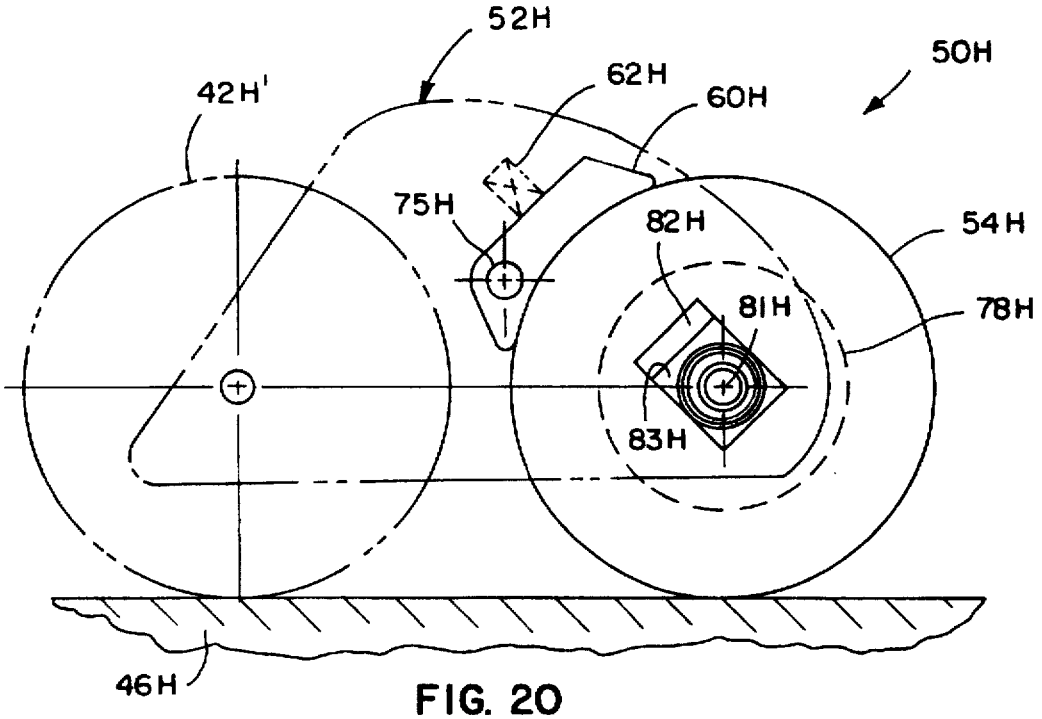
FIG. 20 is a fragmentary side view of another braking system embodying the present invention.

Braking system 50G (FIG. 19) includes an extension 52G pivotally connected to wheel-supporting frame 38G that is comparable to extension 52F in FIG. 17. Also, cuff actuated link 148G and braking wheel 54G including hub 96G (FIG. 19) are comparable to link 148F and braking wheel 54F including hub 96F (FIG. 17). However, a brake pad 60G (FIG. 19) is used that is fixedly secured to extension flanges 66G and 67G by three rivet-like fasteners 74G. (Compare to FIG. 7.) Notably, brake pad 60G includes a body 90G and a brake liner 91G for increased durability.

Figure 21:
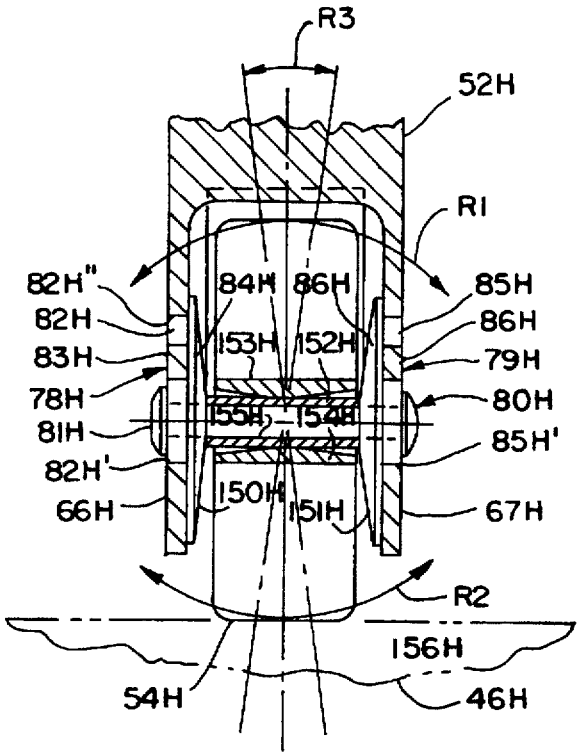
FIG. 21 is a rear end view of the braking system shown in FIG. 20.
Figure 22:
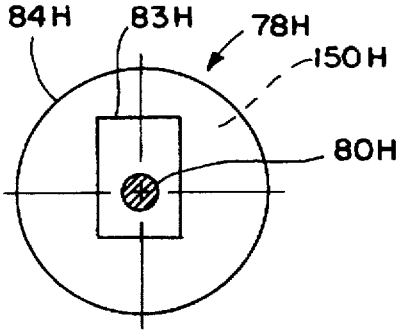
FIG. 22 is a side view of the slide member shown in FIGS. 20 and 21.
Figure 23:
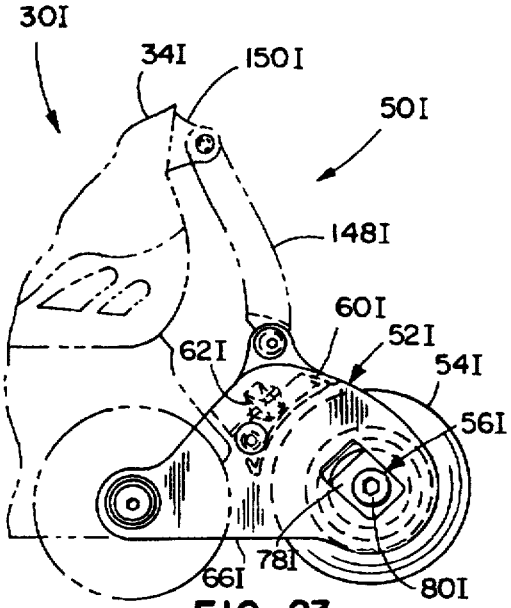
FIG. 23 is a fragmentary side view of yet another braking system embodying the present invention.
Figure 24:
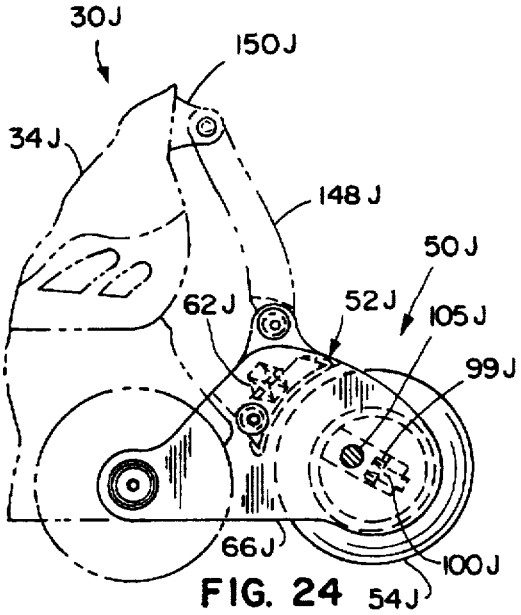
FIG. 24 is a fragmentary side view of yet another braking system embodying the present invention.
Figure 25:
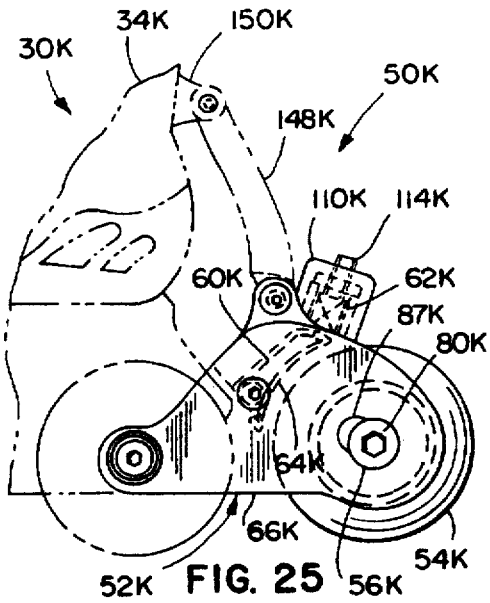
FIG. 25 is a fragmentary side view of yet another braking system embodying the present invention.
Figure 26:
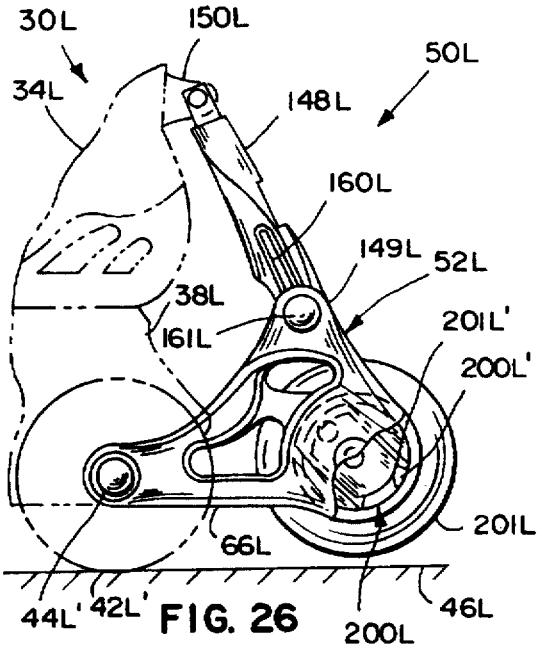
FIG. 26 is a fragmentary side view of an internally operated braking system embodying the present invention, the braking system including an internal braking mechanism, a cuff-actuated link and a pivoted extension.
Figure 27:
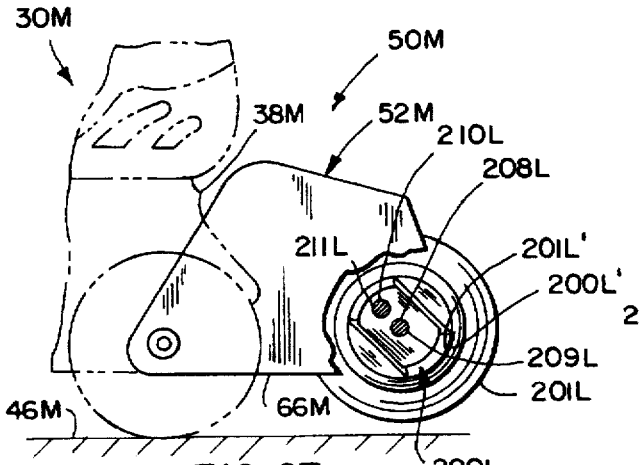
FIG. 27 is a side view of yet another braking system embodying the present invention, the braking system including an internal braking mechanism and a fixed extension.

Braking system 50H (FIGS. 20–22) is closely related to braking system 50 (FIG. 2), except that braking system 50H has been modified to allow braking wheel 54H to pivot from side-to-side as shown by arrows R1 and R2 in FIG. 21. The angle of rotation is indicated by angle R3.

Specifically, extension 52H, brake shoe 60H and brake wheel 54H (FIGS. 20–22) are identical to extension 52, brake shoe 60 and brake wheel 54 (FIG. 2). Additionally, slide members 78H and 79H (FIGS. 20–22) are similar to slide members 78 and 79 (FIG. 2). Specifically, slide member 78H further includes a rectangular section 83H for engaging slot 82H in extension flange 66H and a "planar" section or slide washer 84H for engaging the inside surface of flange 66H. However, "planar" section 84H includes a tapered inner surface 150H. Also, slide member 79H includes rectangular section 86H for engaging extension flange slot 85H, and a "planar" section 87H for engaging the inside surface of flange 67H. However, "planar" section 86H includes a tapered inner surface 151H.

A sleeve 152H is mounted on braking wheel axle 80H and a bearing 153H having a double outwardly tapered hole 154H is positioned on sleeve 152H. The double outwardly tapered hole 154H creates a fulcrum at the center 155H of bearing 153H along the central plane 156H of braking wheel 54H. Bearing 153H can pivot on fulcrum point 155H such that braking wheel 54H is allowed an excursion out of plane 156H by the angle R3. In other words, braking wheel 54H can pivot along paths R1/R2 until the axle 80H engages the tapered hole 154H and prevents further rotation. The taper in surfaces 150H and 1511H of slide members 78H and 79H allow the braking wheel 54H to pivot the amount of angle R3 without resistance.

The angular movement of braking wheel 54H as shown by arrows RI and R2 allows braking wheel 54H to engage skate-supporting surface 46H at a perpendicular angle to ground surface 46H even though the in-line roller skate 30H is oriented at an angle to ground surface 46H when the skater is applying the brakes. This advantageously allows maximum contact between braking wheel 54H and ground surface 46H. Thus, braking wheel 54H is not likely to skid or slide. Notably, brake pad 60H engages braking wheel 54H and biases it back to an aligned "vertical" position in extension 52H.

It is noted that various features in the embodiments can be combined, and that not all possible combinations are shown herein. These variations and combinations are also contemplated to be within the scope of the present invention. For example, an in-line roller skate 30I (FIG. 23) includes the cuff actuator shown in FIG. 17 and the braking system shown in FIG. 1. Also, the roller skate 30J (FIG. 24) includes the cuff actuator shown in FIG. 17 and the braking system shown in FIG. 7. Still further, in-line roller skate 30K (FIG. 25) includes the cuff actuator shown in FIG. 17 and the braking system shown in FIG. 11. The operation of these roller skates 301, 30J and 30K are evident from the discussion above.

INTERNALLY POSITIONED BRAKING SYSTEMS

An in-line roller skate 30L (FIG. 26) includes an extension 52L pivotally connected to wheel-supporting frame 38L at a rear axle 44L' of rear skate wheel 42L'. A cuff-actuated link 148L is pivotally connected at one end to protrusion 149L of extension 52L, and is pivotally connected at its other end to protrusion 150L of cuff support 34L. Link 148L can be fixed in length, but the illustrated link 148L is adjustable by adjustment of threaded extension bolt 160L. The length of link 148L is then set by securing locking nut 161L. Braking system 50L includes extension 52L, and further includes an internally actuated braking mechanism formed by a hub 200L and a braking wheel 201L rotatably supported by 200L. As described below, hub 200L and braking wheel 201L include friction-generating surfaces 200L' and 201L, respectively, that generate a braking portion therebetween when the roller skate is pivoted rearwardly to rollingly engage the braking wheel 201L with the skate-supporting surface 46L.

A second in-line roller skate 30M (FIG. 27) includes an extension 52M fixedly connected to the trailing end of frame 38M. Braking system 50M includes an extension 52M, and further includes a hub 200L and a braking wheel 201L (i.e. identical to that shown in FIG. 26). As the roller skate 30M is pivoted rearwardly, the braking wheel 201L rollingly engages the skate-supporting surface 46M causing a braking force to be generated on braking wheel 201L by hub 200L, as described below.

Figure 29:
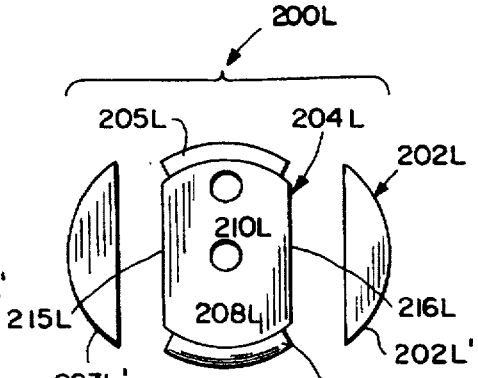
FIG. 29 is an exploded side elevational view of the internal braking system shown in FIG. 28.
Figure 28:
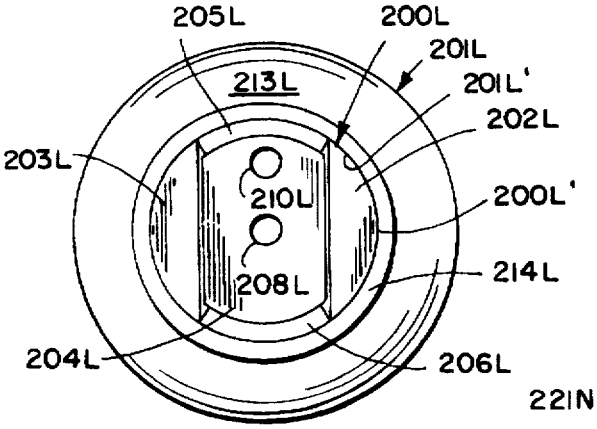
FIG. 28 is an enlarged side view of the internal braking mechanism used in the roller skates shown in FIGS. 26 and 27.
Figure 30:
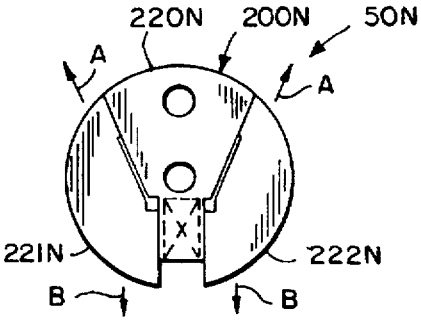
FIG. 30 is a side view of another internal braking system embodying the present invention.
Figure 31:
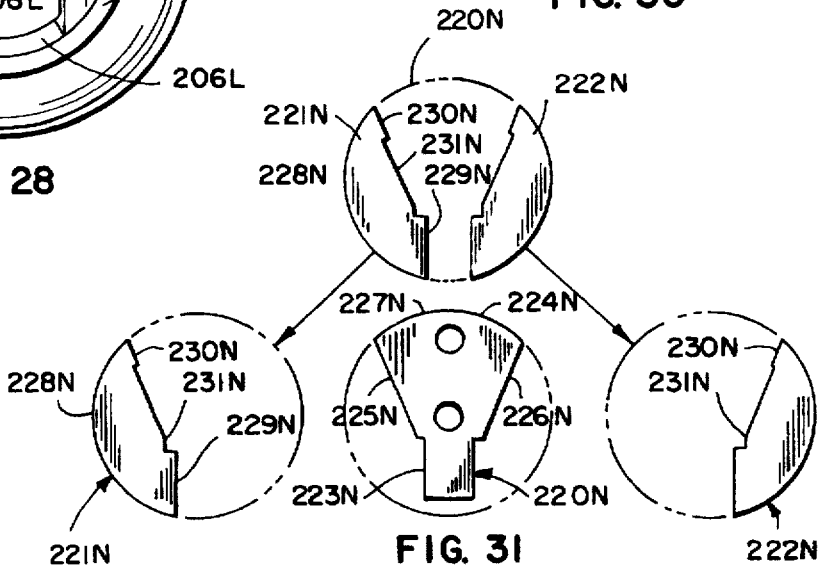
FIG. 31 is an exploded view of the internal braking system shown in FIG. 30.

The internally actuated braking mechanism formed by hub 200L and braking wheel 201L are shown in more detail in FIGS. 28–29. Hub 200L includes opposing side members 202L and 203L located on opposing sides of a center piece 204L. Center piece 204L is fixed between the sides of extension 52L and frictionally engaged therewith, but side members 202L and 203L and thus braking wheel 201L are movable relative to center piece 204L to create a braking force when braking wheel 201L is pressed rollingly against hard surface 46L as described below. A pair of friction-generating leather braking shoes 205L and 206L are positioned at the opposing arcuately shaped ends of center piece 204L. Shoes 205L and 206L can be adhered to center piece 204L or they can be allowed to float thereon. If allowed to float, shoe 206L will slide circumferentially into engagement with side member 202L to cause additional braking action. When assembled together, the outer surfaces 202L' and 203L' of opposing side members 202L and 203L, and leather braking shoes 205L and 206L form a substantially continuous outer circular surface 200L' that mateably slideably engages the inner surface 201L' of braking wheel 201L.

Figure 29A:
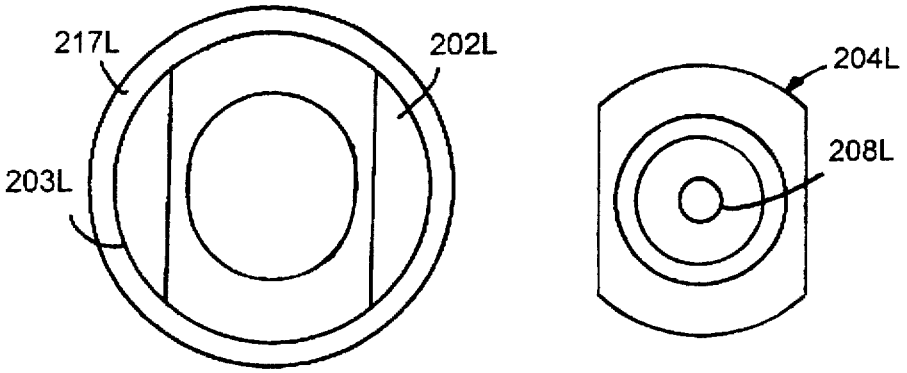
FIGS. 29A & 29B are exploded side elevational views of alternative embodiments of the internal braking system shown in FIG. 28.
Figure 29B:
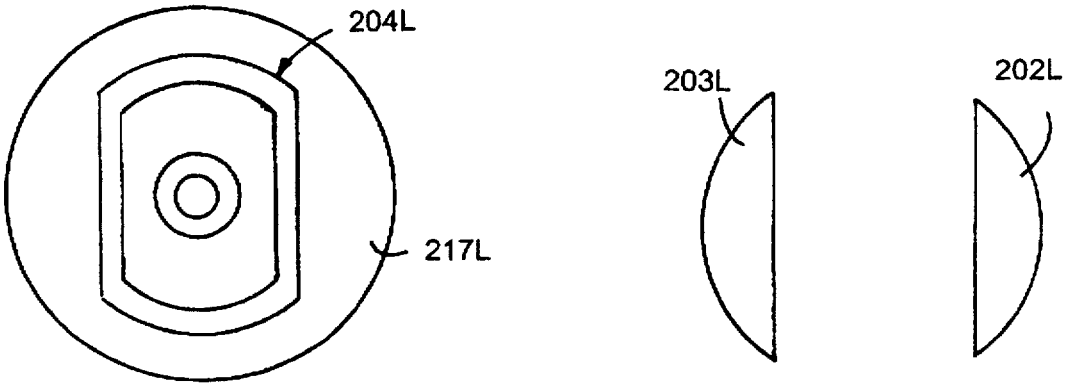
Figure 32:
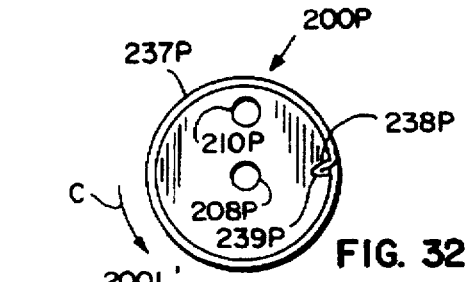
FIGS. 32–39 are side views of several additional internal braking systems embodying the present invention.

Center piece 204L includes a pivot pin supporting transverse hole 208L centrally positioned therein for receiving a fastener or pin 209L, and further includes a second hole 210L spaced from first hole 208L for receiving a second fastener 21 1L. Fastener 209L secures hub 200L between and through the opposing side members 66 of extension 52L so that it holds side members 66L of extension 52L together. Fastener 211 L engages a slot or depression on the inside of side members 66L in extension 52L to prevent rotation of center piece 204L of hub 200L. Alternatively, fastener 211L can be eliminated, in which case the extension side members 66L are clamped together against center piece 204L to frictionally engage center piece 204L and prevent its rotation. Braking wheel 201L includes a rubber or durable polymeric rim 213L and further includes a liner/bushing 214L for engaging the outer surface 200L' of hub 200L. It is contemplated that bushing 214L can be manufactured from many different materials such as bronze, steel or plastic. Also, the components 202L, 203L and 204L of hub 200L can be manufactured of different components such as plastic, aluminum, zinc or hard rubber. It is further noted that braking shoes 205L and 206L can be made from various materials optimally suited for making braking shoes. Alternatively, this embodiment may incorporate side members 202L and 203L that are attached to a common side wall 217L. (FIG. 29A) or center 204L may be attached to side wall 217L (FIG. 29B). Side wall 217L may be formed to be an extension of the wheel-supporting frame.

In operation, when a skater pivots in-line skate 30L (or skate 30M) rearwardly (FIGS. 2629A), braking wheel 201L and hub side members 202L and 203L are biased in a direction parallel the inner surfaces 215L and 216L defined on opposing sides of center piece 204L. This causes braking shoe 206L to engage inner surface 200L' on hub 200L. Also, since the forces generated by skate-supporting surface 46L on braking wheel 201L are non-parallel the slide surfaces 215L and 216L, there is a degree of twisting or torquing on center piece 204L. This causes opposing members 202L and 203L to engage inner surface 200L' with increased force, thus causing some additional frictional forces to be generated. Notably, center piece 204L can be reversed 180° in roller skate 30L such that the opposing braking shoe 205L is positioned in a primary braking position. Also, it is noted that the angle defined by center piece 204L with the ground 46L determines the proportion of forces against braking shoes 205L/206L. Thus, by changing this angle, such as by supporting center piece 204L at a different angular position on a roller skate, the amount of and rate of change of braking force generated by braking system 50L can be customized. Center piece 204L is frictionally retained on the extension at an optimal angel of about 45° to horizontal. Testing has shown that a more vertical angle tends to allow the braking wheel to lock up more quickly than desired, and a more horizontal angel tends to not provide sufficient braking force. Due to the distribution of forces at the 45° angle and the unequal length moment arms on the hub and the braking wheel, the resultant torque caused by the hard surface on the braking wheel has a mechanical advantage over the torque caused by the friction-generating surfaces of the hub such that the braking wheel does not tend to skid on the hard surface. If greater force is placed on the braking wheel, greater braking forces are generated. However, the mechanical advantage continues to prevent lockup and skidding, which would cause unacceptable flat spots on the braking wheel.

Another braking system 50N (FIGS. 30–31) includes a hub 200N that can be used in conjunction with braking wheel 201L and that can be used with either of in-line roller skates 30L or skate 30M as a replacement for hub 200L. Hub 200N includes a modified center piece 220N positioned between a pair of modified opposing side members 221N and 222N. Center piece 220N includes a generally rectangular protruding end section 223N and further includes an enlarged section 224N defined by a pair of angled side surfaces 225N and 226N. The outer surface 227N is arcuately-shaped for mateably engaging inner surface 201L' (FIG. 28). Opposing side members 221N and 222N have an identical shape and are mirror images of each other as positioned against center piece 220N. Side member 221N includes an arcuate surface 228N for engaging inner surface 201L' of braking wheel 201L. Side member 221N further includes a planar surface 229N for engaging one side of protruding end section 223N. Side member 221N further includes an angled surface 230N for engaging angled surface 225N on center piece 220N. A cutaway 231N on angled surface 230N provides clearance along a portion of angled surface 230N between angled surface 230N and inclined surface 225N.

As a skate engages braking wheel 201L against the skate-supporting surface 46L, center piece 220N engages side members 221N and 222N with a wedge-like action to spread apart opposing side members 221N and 222N in directions "A" such that the braking force generated by braking system 50N between surfaces 228N on side members 221N and 222N on the corresponding braking wheel surface 200L' is substantial. Notably, by reversing hub 200N by 180°, the center piece 220N engages side members 220N and 221N in a manner causing a lower rate of increase of braking force as the braking wheel is pressed on a skate-supporting surface. A reason is because, in the reversed position, side members 220N and 221 N are moved in directions "B" that are parallel. Thus, center piece 220N does not act like a wedge per se. It is noted that the center piece 220N and arcuate sections 221 N and 222N are loosely mounted within braking wheel 201 L such that the sections and pieces tend to move into an unstressed non-braking position when braking wheel 201L is removed from engagement with skate-supporting surface 46L. However, it is also contemplated that a spring can be operably secured transversely in protruding end section 223N for biasing opposing side members 221N and 222N apart to provide an initial braking force.

A one-piece hub 200P (FIG. 32) includes holes 208P and 210P. A strip of leather 237P is wrapped around hub 200P. One end 238P of the leather 237P is doubled back and inserted into a notch 239P along the outer surface of hub 200P. The opposing end 240P of the leather strip 237P remains free. When hub 200P is positioned within a braking wheel 201L, the strip of leather 237P is securely held between the outer surface of hub 200P and the inner surface 207L. If braking wheel 201 is rotated in a first direction "C", hub 200P and the strip of leather 237P provides normal braking force on braking wheel surface 201L' to slow the rotation of braking wheel 201L. However, if braking wheel 201L is attempted to be rotated in a direction opposite direction "C", the end 240P of leather strip 237P bunches between inner surface 201L' of braking wheel 201L and the inner surface 200L' of hub 200P such that the brake system 50P will lock up and prevent further rotation of the braking wheel 201L. This arrangement can be advantageous such as to permit quick starts by a skater.

Another braking system (FIG. 33) includes a hub 200Q having a notch 242Q therein. A threaded hole 243Q is located in the bottom of notch 242Q, and a strip of leather 244Q is positioned around hub 200Q with the ends 245Q and 246Q positioned in notch 242Q. A fastener 247Q includes an enlarged wedge-shaped washer 247Q' under its head that retains ends 245Q and 246Q in notch 242Q. In braking system 50Q, braking wheel 201Q can be rotated in either direction with a substantially equivalent braking force being applied, and without any lock up as noted in regard to hub 200P discussed above. It is noted that the holes 208Q and 210Q receive pins similarly to the holes 208L and 210L on centerpiece 204L, as discussed above in regard to hub 200L and as shown in FIG. 27.

Figure 33:
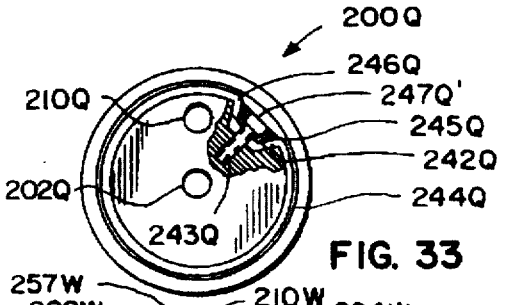
Figure 34:
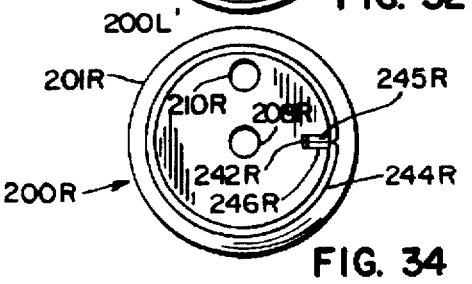
Figure 39:
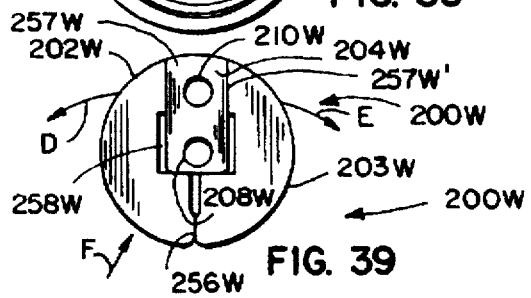
Figure 35:
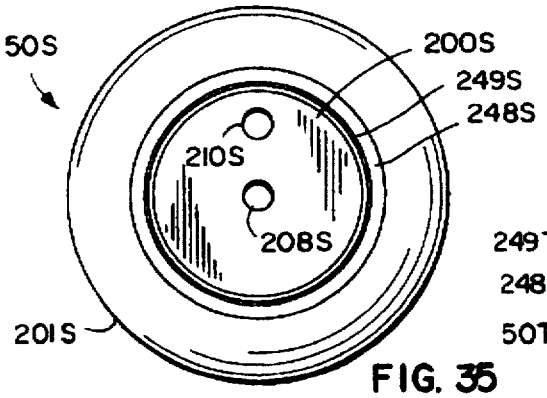
Figure 36:
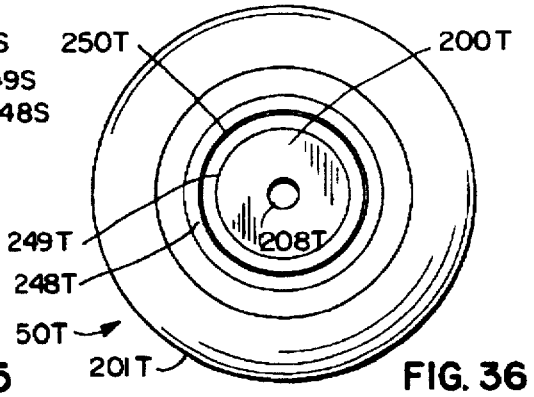
Figure 37:
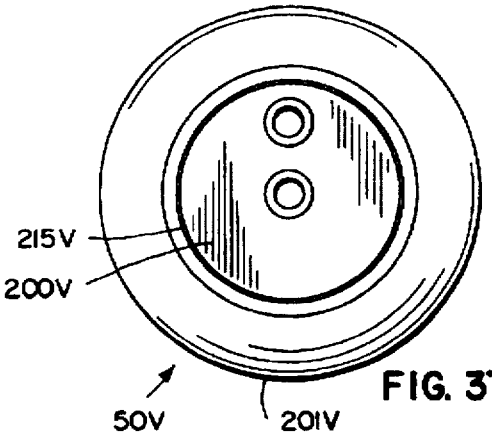

Yet another braking system (FIG. 34) includes a hub 200R and a leather strip 244R not unlike the braking system disclosed in FIG. 33, however the ends 245R and 246R of leather strip 244R are merely tucked into a narrow notch 242R configured to retain the ends of the leather strip 244R without the need for a separate fastener. The ends 244R and 245R are sufficiently sharply deformed and pressed far enough into notch 242R with enough force to retain ends 244R and 245R in notch 242R.

A braking system 50S (FIG. 35) includes a one-piece hub 200S (made of a plastic, aluminum, zinc, polyurethane or other hard material), a friction-generating material 249S coated around the exterior surface of hub 200S, and a braking wheel 201S including a ring-shaped bushing 248S made of a bronze, steel or plastic. Hub 200S includes holes 208S and 210S. Another hub 200T (FIG. 36) is substantially identical to hub 200S but includes only a single hole 208T and has eliminated the second hole. In hub 200T, the side members of extension 52L are secured sufficiently tightly together to engage hub 200T and prevent undesirable rotation thereof when the skater is attempting to brake. Further, hub 200T includes a material 250T attached to the inside of braking wheel 201T to provide a friction-generating surface for engaging friction-generating material 249T. For example, material 250T may be leather, while material 249T is a composite heat conductive material.

In braking system 50U (FIG. 37), both hub 200U and braking wheel 201U comprise a relatively hard, incompressible, rubber material or urethane material. A ring of braking material 251U can be positioned therebetween, if desired, such as a viscous or a semi-hardened non-adherable material to prevent bonding of hub 200U to braking wheel 201U when the braking system 50U becomes hot during use. As braking wheel 201U is engaged with a hard surface, it is forced against hub 200U. The incompressible material of hub 200U is deformed in a first direction and thus bulges in a second direction orthogonal to the first direction. This causes portions of hub 200U in the "bulging" areas of hub 200U to press against braking wheel 201U, thus causing a braking force on braking wheel 201U. Notably, braking wheel 201U may itself undergo some deformation/bulging during braking.

Figure 38:
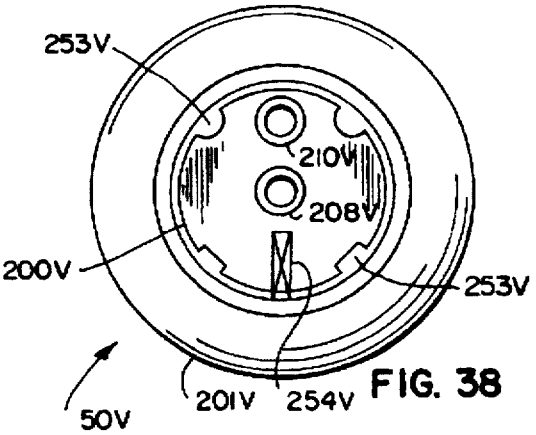

In FIG. 38, hub 200V includes dirt grooves 253V for receiving dirt and abraded particles to help provide a continuous and dependable braking action by the braking system of 50V. Also, a spring or screw 254V is inserted in a side of hub 200V to ensure that hub 200V generates some initial braking force on braking wheel 201 at all times. The screw is adjustable or spring 254V is replaceable or stretchable such that the resulting initial braking force is adjustable.

Hub 200W (FIG. 39) includes a center piece 204W positioned between a pair of opposing side members 202W and 203W. Opposing side members 202W and 203W include abutting surfaces 256W forming a pivot, and further include spaced apart surfaces 257W and 257W' forming camming surfaces. Center piece 204W is positioned between camming surfaces 257W and 257W.

As a skater pivots a roller skate 30W rearwardly such that braking wheel 201W contacts a skate-supporting surface, the direction of forces "F" on braking wheel 201W is misaligned with a centerline on center piece 204W such that the center piece 204W in effect twists within/between opposing side members 202W and 203W. A lower portion of center piece 204W pivots into a recess 258W in side members 202W (or 203W) allowing the sides of center piece 204W to twist and cam against cam surfaces 257W. This causes opposing side sections 202W and 203W to spread apart in directions "D" and "E". In turn, this causes an increased friction due to the increased force of opposing side sections 202W and 203W against the inner surface 207W of braking wheel 201W.

Thus, in-line roller skates are provided with braking systems that include a brake pad and a dynamic braking wheel operably supported on a wheel frame extension. The response of the braking wheel to engagement with a skate-supporting surface and the direct dynamic movement of the braking wheel into the brake pad and/or the hub gives improved control over braking and an improved feel for braking. In one aspect, the braking system is external to the braking wheel. In another aspect, the braking system is internal to the braking wheel, such that the braking system is substantially a self-contained unit, such as for attachment to a roller skate.

It is contemplated that the scope of the present invention of braking systems includes other applications and methods of use. For example, the present braking systems could be used on quad roller skates having two front and two rear wheels arranged in a rectangular pattern, with the braking wheel being a fifth wheel (or fifth and sixth wheels) positioned rearwardly of the axis of rotation of the two rear wheels. Also, the present braking systems could be used on skate boards or other wheeled weight-carrying articles or apparatus. Still further, the present braking systems could be used on a stationary device such as a conveyor for moving objects along at a controlled rate. The material handling conveyor would include a plurality of rotatable wheels for rollingly supporting and moving along packages or boxes at the controlled rate. Notably, the conveyor could be any of a variety of different types, such as powered conveyors or gravity feed conveyors. Also, the wheels could be arranged in a variety of patterns and supported in a variety of ways. Notably, the wheels could be any of the wheels disclosed in this application, and the conveyor could incorporate any of braking systems disclosed herein. In conveyor applications, the internal braking systems are believed to be particularly useful due to the ability to preassemble them and install them as a self-contained unit.

NON-SYMMETRICAL HUB

Braking system 50Y (FIG. 40) has a non-symmetrical hub 200Y which includes dirt grooves 253Y for receiving dirt particles to help provide continuous and dependable braking action. In this embodiment, the term "serration" includes serrations, grooves, knurls, teeth, slots and rough surfaces. This embodiment further includes serrations 262Y for increased braking action. A strip 263Y of material has an inner layer 248Y with desired friction-generating characteristics and is placed freely between hub 200Y and braking wheel 201Y to allow only minimal friction while braking system 50Y is not in use. Also, the strip of material 263Y can be multilayered, or can comprise a single material. Alternatively, braking system 50Y can include a ring-shaped bushing similar to that of braking system 50S. When braking system 50Y is engaged, the force of braking wheel 201Y against the skating surface causes strip 263Y or bushing 248Y to be forced into communication with serrations 262Y of hub 200Y causing the strip to become temporarily fixed to the hub, thus causing friction between strip 263Y and the inner surface of wheel 201Y, creating a braking action. Because the strip of material is not attached to wheel 201Y, when there is no pressure or braking wheel 201Y, the free rotation of the strip allows cooling of the strip and distributes the use and wear of strip 263Y.

BRAKING WHEEL AS REAR IN-LINE WHEEL

A skate with a rear braking wheel attached to the original wheel-supporting frame is shown in FIG. 41. In this alternative, the original rear in-line wheel is removed from the wheel-supporting frame 38 and replaced by the brake mechanism. Other original wheels may be removed, but at least two "riding" wheels must remain. One of the above-described internal brake wheel systems is attached in the rear wheel position of the wheel-supporting frame. Many commercial in-line skates are equipped with a "rocker" system on each of its wheels which allows each wheel to be independently moved up or down slightly on the frame with respect to each other. In this embodiment of the present invention, at least two of the remaining "riding" wheels 42 would be rockered "down" and the braking wheel 54 would be rockered "up," so that when skating, the riding wheels are all touching the ground and the braking wheel does not touch the ground or only lightly touches the ground. When the user wishes to have braking, the skate needs to be tipped back slightly to engage the braking wheel with the skating surface. This embodiment allows for quick and responsive braking, which is desired in hockey and other fast-paced skating sports.

To achieve even more clearance between the rear braking wheel 54 and the skating surface than rockering provides, an adjustable pivot extension 53 may be added to the wheel-supporting frame. The side wall of the braking system may form pivot extension 53. (See FIG. 42) A cuff linkage system similar to the ones described below may be used to activate the pivot extension for more ground clearance.

LINKAGE SYSTEMS

Figure 43:
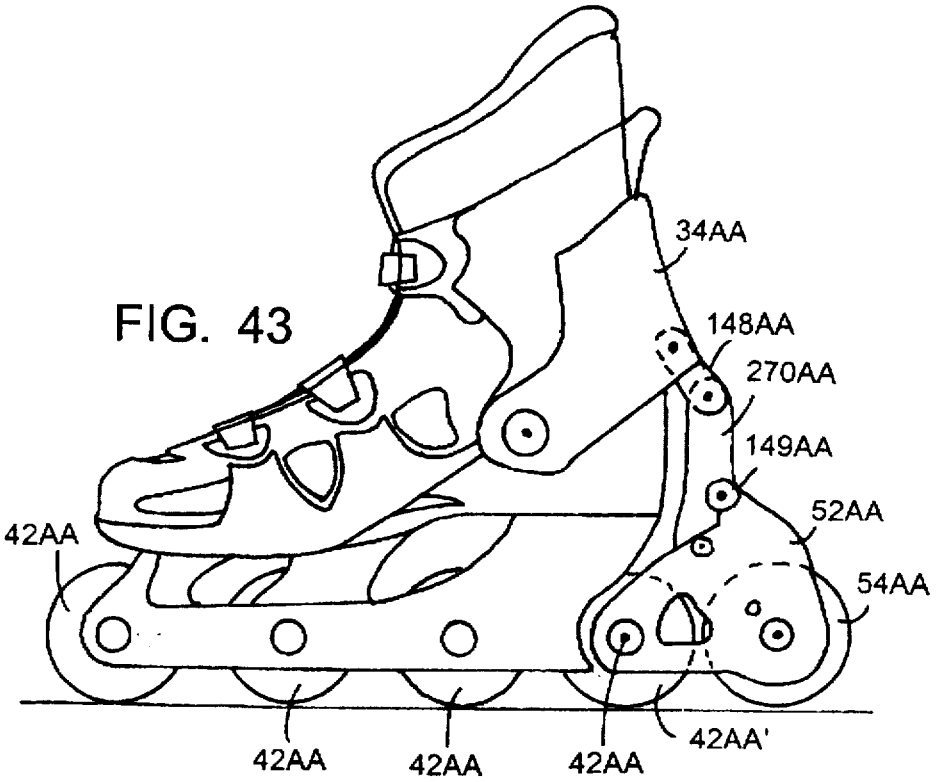
FIG. 43 is a side view of an in-line skate with a braking system embodying the present invention where the braking system is not engaged.
Figure 44:
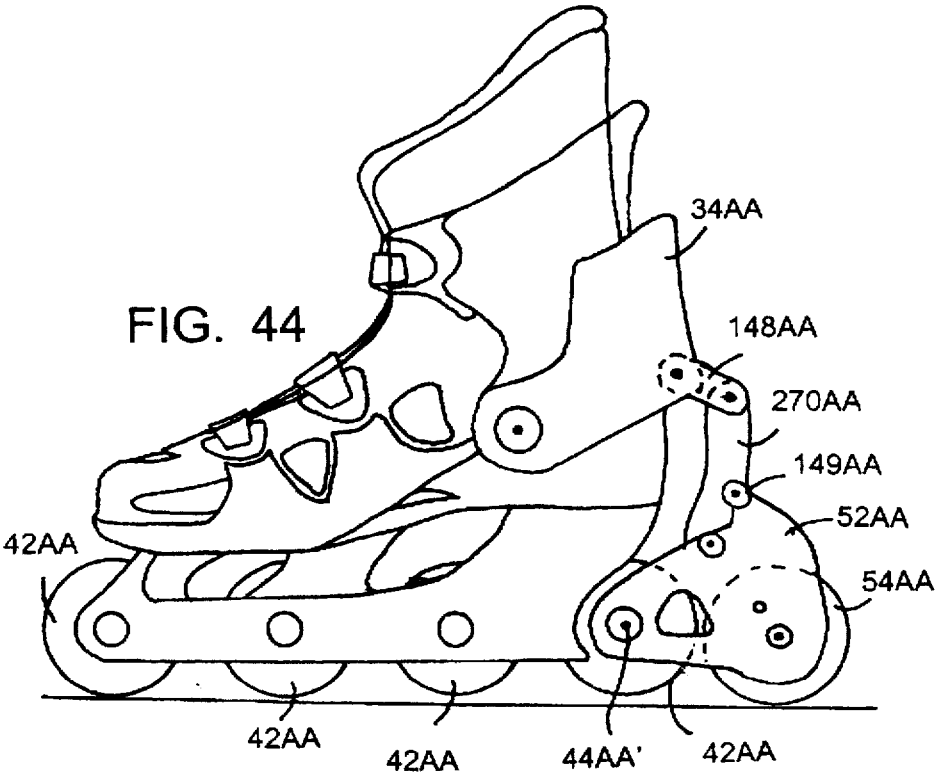
FIG. 44 is a side view of an in-line skate with the braking system of FIG. 43 where the braking system is engaged with such a strong force that the rear of the skate is lifted.

FIG. 43 shows an embodiment of the present braking system invention that includes a short upper link 148AA attached pivotally to cuff 34AA. Upper link 148AA is further pivotally attached to a long lower link 270AA. Lower link 270AA is fixedly (non-rotatably) attached to an extension or braking subframe 52AA that houses braking wheel 54AA. The arrangement of upper link 148AA, lower link 270AA, extension 52AA, and the roller skate shoe forms a four-bar linkage that provides mechanical advantage when actuating the braking wheel 54AA. Specifically, when cuff 34AA is rocked back by the leg of the user, upper link 148AA is forced against lower link 270AA, causing upper link 148AA to jut rearwardly/outwardly, thus causing lower link 270AA to move outward and downward relative to the boot of the skate. (See FIG. 44). Extension 52AA rotates about axle 44AA', causing braking wheel 54AA to engage the skating surface. Braking wheel 54AA is equipped with one of the above-mentioned internal braking systems. As braking wheel 54AA engages the skating surface, the braking system engages causing the skate to be braked. Notably, if the skating surface is engaged with enough force, all of wheels 42AA with the exception of the front wheel can be lifted off of the skating surface. This is due to the mechanical advantage provided by the linkage system. The release of the rear wheels 42AA from the skating surface results in more friction force on the front and rear wheels, causing superior braking action while also facilitating quick but controlled turns or alignment and stability for higher and lower speed straight stopping. This allows a skater to turn sharply and quickly, such as when the roller skate is used for hockey or figure skating. The linkage system of the present embodiment can be designed to lock if the user's leg is rocked rearward far enough. In such case, the linkage system will unlock by rocking the user's leg forward, and thus moving the cuff forward and the braking wheel upward.

FIG. 45 shows another embodiment of the present braking system invention which includes an upper link 148BB fixedly attached to cuff 34BB. Upper link 148BB is further pivotally attached to lower link 270BB. This braking system is similar to the braking system of FIGS. 43–44, but upper link 148BB and lower link 270BB in this embodiment are approximately the same length. Lower link 270BB is fixedly attached to an extension 52BB that houses braking wheel 54BB. Cuff 34BB pivots around point 269BB. When cuff 34BB is rocked back about pivot 269BB by the leg of the user, upper link 148BB is forced against lower link 270BB, causing upper link 148BB to move downward and causing lower link 270BB to move downward and outward relative to the boot of the skate (FIG. 46). Extension 52BB rotates about axle 44BB', causing braking wheel 54BB to engage the skating surface. Braking wheel 54BB is equipped with one of the above-mentioned internal braking systems. As braking wheel 54BB engages the skating surface, the brake system engages, causing the skate to slow. If the skating surface is engaged with enough force, all of wheels 42BB with the exception of the front wheel, can be lifted off of the skating surface similarly to FIG. 44. Again, due to the increased friction, this allows a skater to turn sharply such as when the roller skate is used for hockey or figure skating, or allows alignment and stability for higher and lower speed straight stopping. The required force to move the cuff is many times less than the resultant brake wheel force against the skating surface. This is due to the relationship of the linkage pivot points to each other so as to develop the maximum mechanical advantage to multiply the initial cuff force.

Figure 47:
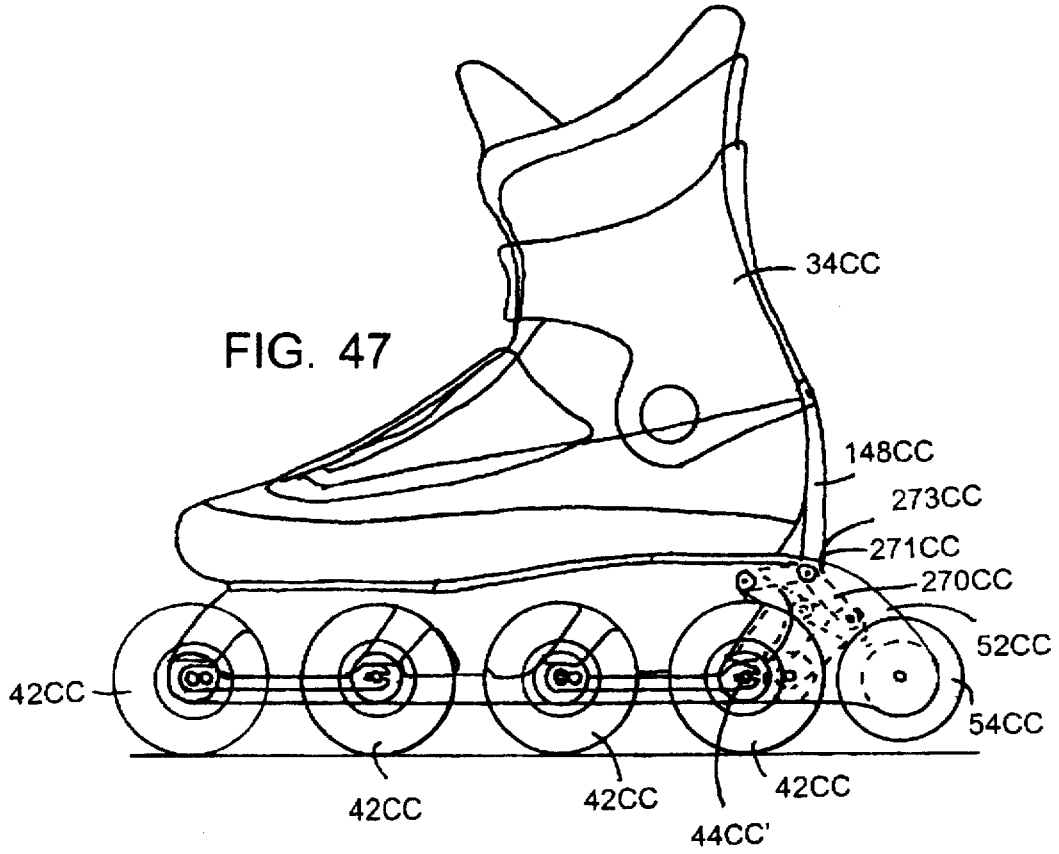
FIG. 47 is a side view of a modified in-line skate with a braking system embodying the present invention that is not unlike the embodiment of FIG. 45 and where the braking system is not engaged.
Figure 48:
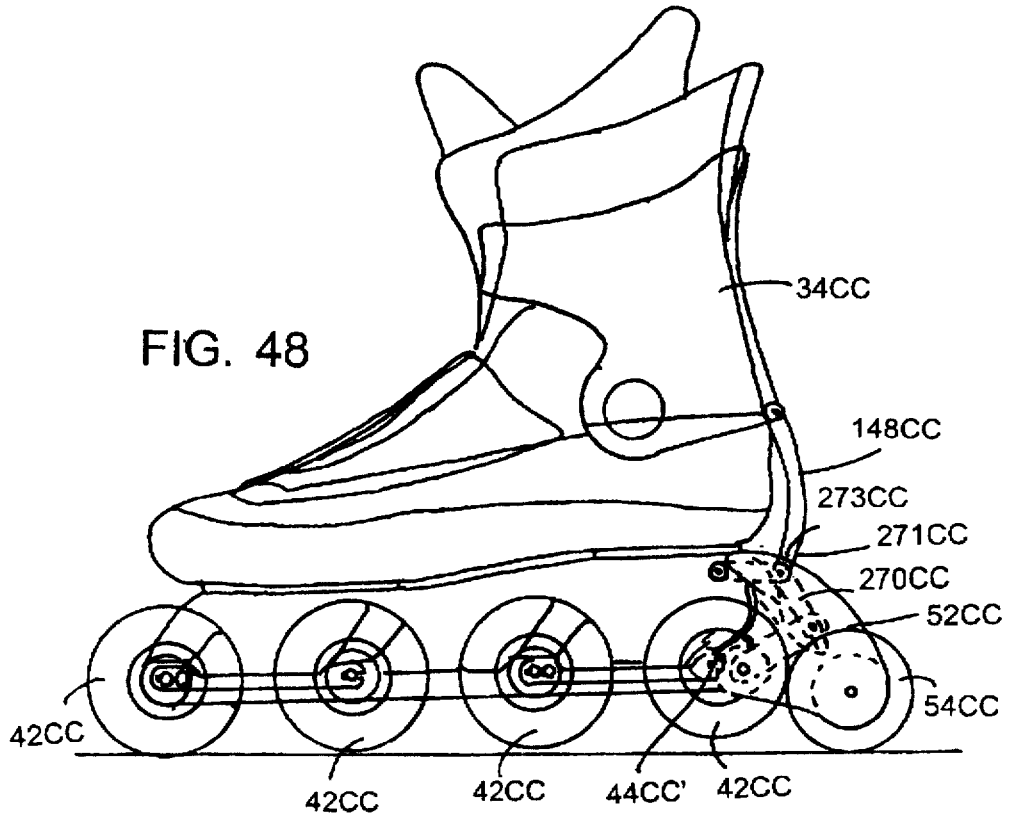
FIG. 48 is a side view of the in-line skate of FIG. 47 where the braking system is engaged.

FIG. 47 shows yet another embodiment of the braking system invention including a long upper link 148CC pivotally attached to cuff 34CC. Upper link 148CC is further pivotally attached to a short lower link 270CC. A third link 271CC is attached at pivot point 273CC where upper link 148CC and lower link 270CC attach. Link 271CC is attached at its other end to wheel-supporting frame 38CC creating yet another pivot point. Lower link 270CC is pivotally attached to an extension 52CC which houses braking wheel 54CC. When cuff 34CC is rocked back by the leg of the user, upper link 148CC is forced against lower link 270CC, causing pivot point 273CC and lower link 270CC to move downward and outward relative to the boot of the skate (FIG. 48). This braking arrangement provides a significant mechanical advantage because as the lower links 270CC and 271CC are forced downwardly, they pivot toward an aligned position. The closer links 270CC and 271CC are to the aligned position, the greater the mechanical advantage, and the greater the force generated for moving the extension 52CC. Extension 52CC rotates about axle 44CC, causing braking wheel 54CC to engage the skating surface. Braking wheel 54CC is equipped with one of the above-mentioned internal braking systems. As braking wheel 54CC engages the skating surface, the brake system engages causing the skate to slow. Again in this embodiment, if the skating surface is engaged with enough force, all of wheels 42CC with the exception of the front wheel, can be lifted off of the skating surface. Again, due to the increased friction, this allows a skater to turn sharply such as when the roller skate is used for hockey or figure skating or allows alignment and stability for higher and lower speed straight stopping. The linkage system of the present embodiment will lock if the user's leg is rocked rearward far enough. The linkage system can be unlocked with minimal force by rocking the user's leg forward and thus moving the cuff upward. Advantageously, the linkage of this embodiment is low, such that the linkage can be more easily shielded from debris or hidden for aesthetics. The required force to move the cuff is many times less than the resultant brake wheel force against the skating surface. This is due to the relationship of the linkage pivot points to each other so as to develop the maximum mechanical advantage to multiply the initial cuff force.

Figure 49:
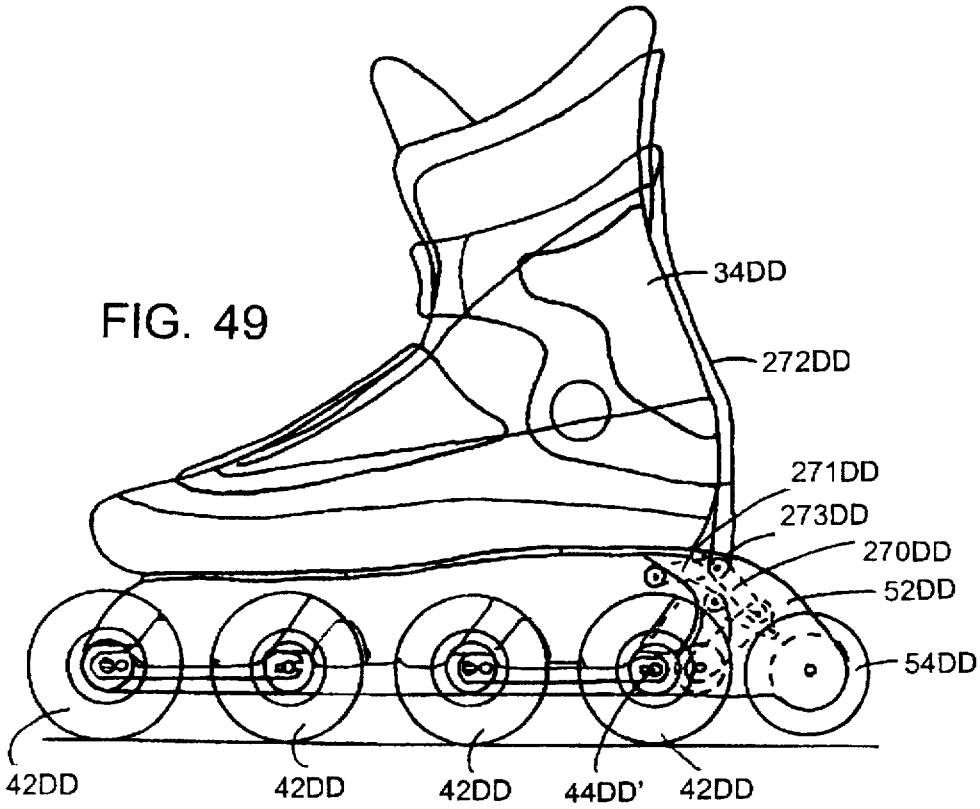
FIG. 49 is a side view of a modified in-line skate with a braking system embodying the present invention that is not unlike the embodiment of FIG. 47 and where the braking system is not engaged.
Figure 50:
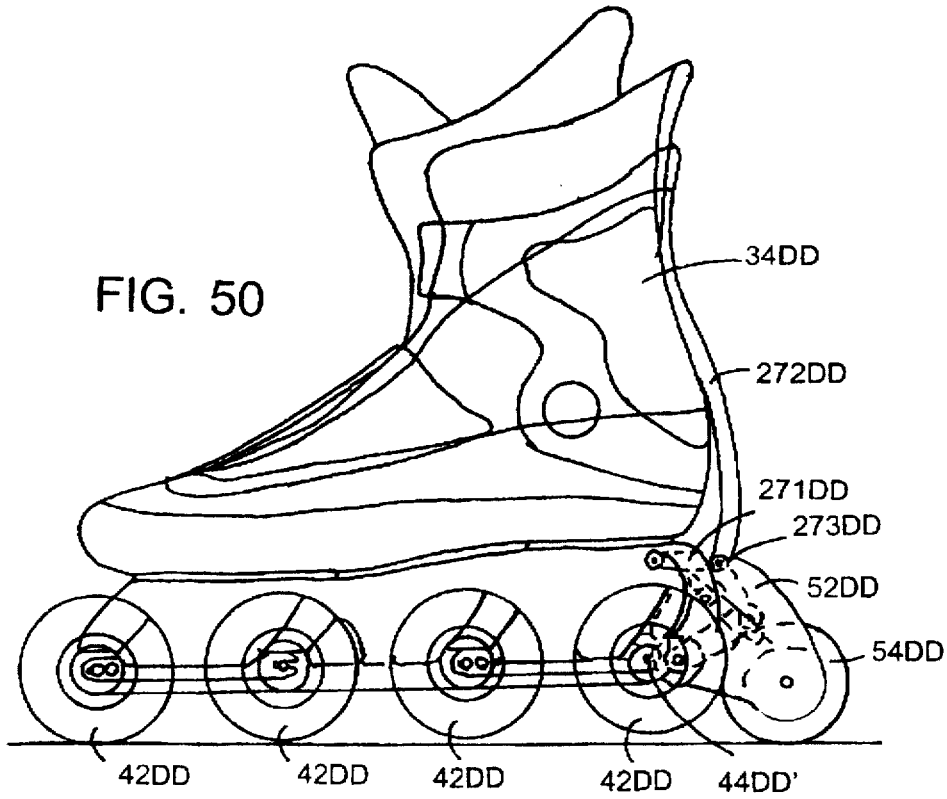
FIG. 50 is a side view of the in-line skate of FIG. 49 where the braking system is engaged.
Figure 51:
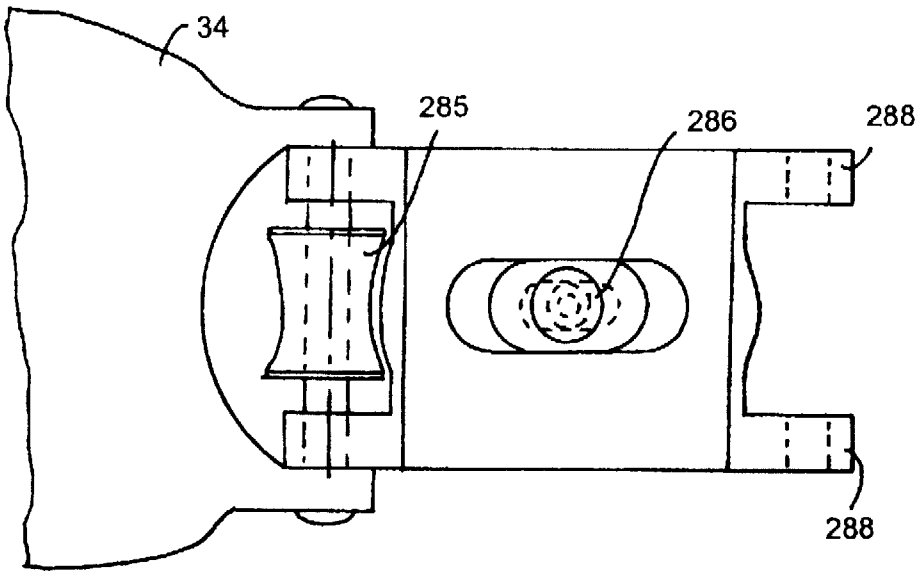
FIG. 51 is a top view of an adjustable toggle assembly for use as a link in any of the previously disclosed braking systems that use links.
Figure 52:
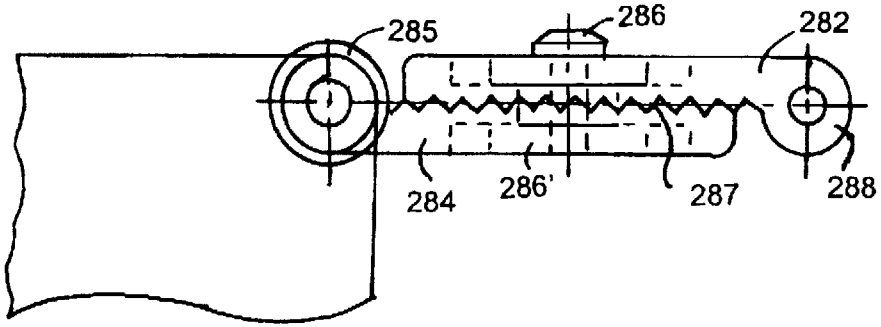
FIG. 52 is a side view of the adjustable toggle link assembly in FIG. 51.
Figure 53:
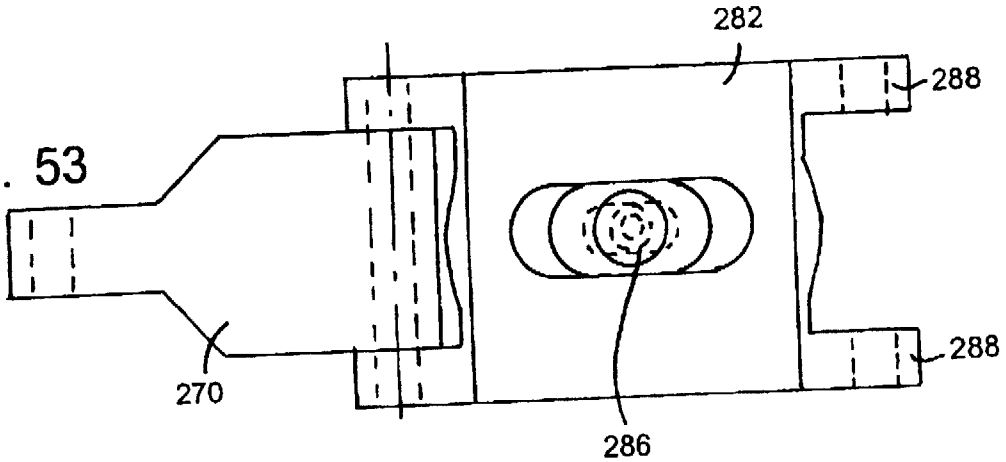
FIG. 53 is a top view of an adjustable toggle assembly for use as a link in any of the previously disclosed braking systems that use links.
Figure 54:
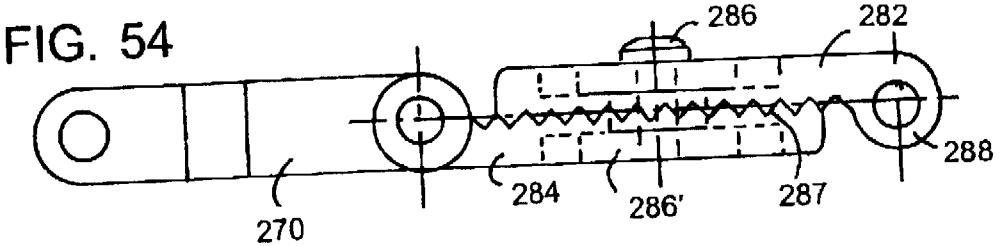
FIG. 54 is a side view of the adjustable toggle link assembly in FIG. 53.

Another embodiment of the present invention is shown in FIG. 49. This embodiment (FIG. 49) is similar to that embodiment of FIG. 47, but the upper link is made flexible in this embodiment. Specifically, the embodiment of FIG. 49 includes a cuff 34DD having a flexible arm 272DD. Arm 272DD extends from cuff 34DD and is attached to a short lower link 270DD. A third link 271DD is attached at pivot point 273DD where upper link 272DD and lower link 270DD attach. Link 271DD is attached at its other end to wheel-supporting frame 38DD creating yet another pivot point and creating extra leverage and support to the braking system. Lower link 270DD is pivotally attached to an extension 52DD which houses braking wheel 54DD. When cuff 34DD is rocked back by the leg of the user, arm 272DD is forced against lower link 270DD, causing upper link 148DD to bend slightly and causing pivot point 273DD and lower link 270DD to move downward and outward relative to the boot of the skate (FIG. 50). Extension 52DD rotates about axle 44DD', causing braking wheel 54DD to engage the skating surface. Braking wheel 54DD is equipped with one of the above-mentioned internal braking systems. As braking wheel 54DD engages the skating surface, the brake system engages, causing the skate to slow. The required force to move the cuff is many times less than the resultant brake wheel force against the skating surface. This is due to the relationship of the linkage pivot points to each other so as to develop the maximum mechanical advantage to multiply the initial cuff force. Due to increased friction, alignment and stability result for higher and lower speed straight stopping.

An adjustable link assembly 280 for the braking system of the present invention is shown in FIGS. 51–54. Adjustable link assembly 280 can be used in any of the aforementioned linkage systems. The assembly includes top member 282 which is attached to a bottom member 284 by a screw 286 and nut 286' for holding the jagged portions 287 on both the top member and the bottom member together. In one alternative of link assembly 280, link assembly 280 attaches directly to the cuff and includes a pivotal roller 285 which, for example, can roll against the rear surface of the boot of the in-line roller skate. (FIGS. 51 and 52) This sliding/rolling movement is important since, as a skater leans rearwardly to move his/her cuff to actuate the present braking system, the cuff is reinforced as it moves rearwardly and downwardly along the rear/heel of the boot. Thus, the linkage (e.g., link 148AA) must be made to slide/roll on the rear/heel of the boot to back up the force generated between the linkage and brake of the braking system. The slide/roll system also absorbs force returning from the skating surface to the braking system. The roller alternative is used with the "mid-toggle" linkage system shown in FIG. 45 and 46. The roller allows less marring of the boot and greater force reaching the braking wheel from the cuff. In another alternative, link assembly 280 is attached to another link in the linkage system. (FIGS. 53 and 54) In this alternative, no roller is needed. Top member 282 can be attached to braking wheel 54 by attaching hub 200 between opposing attachment elements 288. Link assembly 280 is adjusted by removing or loosening screw 286 and nut 286', thus allowing top member 282 to move away from bottom member 284. Thereafter, top member 282 can be adjustably moved along bottom member 284 to either lengthen or shorten the amount of space between braking wheel 54 and the skating surface, thereby adjusting the travel of braking wheel 54.

FIG. 55 shows the braking system of the present invention with a mechanism to allow a wheel or tire portion 77 to be easily snapped onto the braking drum. The drum of the wheel includes annular flanges 292 on its lateral sides and is made of bronze, aluminum or a composite material suitable for generaing friction with minimum wear. Annular flanges 292 are sufficiently short to allow flexible tire portion 77 to be easily snapped on, while being long enough and resilient enough to hold wheel or tire portion 77 on the hub securely after the snapping engagement even when a large force is encountered. The drum may further include serrations or grooves to assure that no unwanted slipping of the braking wheel or tire occurs when the braking system is in use. The tire can be made of a flexible polyurethane or other similar flexible but durable material. The resiliency/flexibility of the tire material partially determines the height of the drum flanges 292.

It is noted that the above-discussed linkage mechanisms could also be used on other skate braking systems, even those using totally different braking devices, such as with a friction/skid block-type brake.

While the preferred embodiments of the present invention have been described, it should be understood that various changes, adaptations, combinations, and modifications may be made therein without departing from the spirit of the invention and the scope of the appended claims.

The embodiments of the invention in which an exclusive property or privilege is claimed are defined as follows:

1. A brake assembly for attachment to an in-line roller skate having a wheel-supporting frame and a plurality of aligned wheels operably supported by the wheel-supporting frame and adapted to rolling engage a supporting surface, the brake assembly comprising:

an extension frame member having first and second ends, the first end being connected to said wheel-supporting frame;

an integral hub member fixedly connected to the second end of said extension frame member, the hub member having a cylindrical-shaped outer circumferential surface;

a strip of material extending about a substantial portion of the outer circumferential surface of the hub member, the strip of material having opposing ends, at least one end being secured to the hub member; and an annular-shaped braking wheel having inner and outer circumferential surfaces, the braking wheel being rotatably mounted on said hub member with the strip of material positioned between the hub member and the inner circumferential surface of the braking wheel, wherein rolling engagement of the braking wheel with the supporting surface, upon pivotable movement of the roller skate, forces the inner circumferential surface of the braking wheel into frictional engagement with the strip of material for generating a braking force on the braking wheel.

2. The brake assembly defined in claim 1, wherein the strip of material comprises a strip of leather.

3. The brake assembly defined in claim 1, wherein the strip includes opposing ends, both of said opposing ends being secured to said hub.

4. The brake assembly defined in claim 1, wherein said hub includes a recess for receiving the at least one end.

5. The brake assembly defined in claim 4, including a fastener extending into the recess for retaining the at least one end.

6. The brake assembly defined in claim 1, including a link connected to the extension frame member for actuating the braking mechanism.

7. The brake assembly defined in claim 6, including a cuff on the in-line roller skate, and wherein the link is connected to the cuff.

8. The brake assembly defined in claim 1, including a second strip of material extending at least partially around the hub.

9. The brake assembly defined in claim 1, wherein one of the hub and the braking wheel includes serrations engaging said strip of material.

10. The brake assembly defined in claim 1, wherein the strip of material is attached to the hub along intermediate portions of its length.

11. The brake assembly defined in claim 1, wherein the first end of the extension frame member is pivoted to the wheel-supporting frame.

12. The brake assembly defined in claim 1, wherein the first end of the extension frame member is fixed to tie wheel-supporting frame.

13. The brake assembly defined in claim 1, wherein the strip of material is adhered to the hub.

14. The brake assembly defined in claim 1, wherein the strip of material comprises a rubber material.

15. The brake assembly defined in claim 1, wherein the strip of material includes an intermediate section between the opposing ends that is separate from and characteristically not connected to the hub.

16. The brake assembly defined in claim 1, wherein said hub includes a first member and a second member movable relative to the first member, the first and second members being configured to wedge against each other and press the strip of material against the braking wheel when the in-line roller skate is pivoted to rollingly engage said braking wheel with the supporting surface.

17. The brake assembly defined in claim 1, including a cuff on the in-line roller skate, and a link operably connecting the cuff to the braking mechanism for generating a braking force on a braking wheel when the roller skate or the cuff is pivoted to rollingly engage said braking wheel with the supporting surface.

18. A brake assembly for attachment to an in-line roller skate having a wheel-supporting frame and a plurality of aligned wheels operably supported by the wheel supporting frame and adapted to rolling engage a supporting surface, the brake assembly comprising:

an extension frame member having first and second ends, the first end being connected to said wheel-supporting frame;

an integral hub member fixedly connected to the second end of said extension frame member, the hub member having a cylindrical-shaped outer circumferential surface;

a strip of material having opposite ends, the strip of material being secured at only one end to the hub member, the strip of material having an unsecured portion extending about a substantial portion of the outer circumferential surface of the hub member; and an annular-shaped braking wheel having inner and outer circumferential surfaces, the braking wheel being rotatably mounted on said hub member with the strip of material positioned between the hub member and the inner circumferential surface of the braking wheel, wherein rolling engagement of the braking wheel with the supporting surface, upon pivotal movement of the roller skate, forces the inner circumferential surface of the braking wheel into frictional engagement with the strip of material for generating a braking force on the braking wheel the unsecured portion of the strip of material to extend around the hub member in a forward direction of rotation of the braking wheel for permitting smooth braking of tile skates in a forward direction of travel, the strip of material adapted to lock the braking wheel relative to the hub during rearward rotation of the braking wheel relative to the hub.

19. A method of operating a brake assembly on an in-line roller skate, the in-line roller skate having a wheel-supporting frame and a plurality of aligned wheels operably supported by the wheel-supporting frame, the aligned wheels being adapted to rollingly engage a supporting surface, comprising steps of:

providing a brake assembly including an extension frame member having first and second ends, the first end being connected to said wheel-supporting frame, an integral hub member fixedly connected to the second end of the extension frame member, the hub having a cylindrically-shaped outer circumferential surface, a strip of material extending about a substantial portion of the outer circumferential surface of the hub member, the strip of material having opposing ends, at least one end being secured to the hub member, and an annular shaped braking wheel having inner and outer circumferential surfaces, the braking wheel being rotatably mounted on the hub member with the strip of material positioned between the hub member and the inner circumferential surface of the braking wheel; and rollingly engaging the braking wheel with the supporting surface including pivoting one of the roller skate and a cuff on the roller skate, in order to force the circumferential surface of the braking wheel into frictional engagement with the strip of material to thereby generate a braking force on the braking wheel.

20. The method defined in claim 19, wherein the strip of material is attached to the hub at one of the opposing ends and is unattached at the other of said opposing ends, and including a step of locking up the braking when the braking wheel is rotated so that another opposing end rotatably moves toward the one opposing end thus compressing the strip of material and causing the strip of material to bunch up and lock up the braking wheel.

21. The method defined in claim 19, including a step of replacing the strip of material to provide a refurbished braking mechanism.

22. The method defined in claim 19, including a step of replacing the strip of material with another strip of material that provides a different coefficient of friction.

* * * * *